US011401567B2

(12) United States Patent
Nakamura et al.

(10) Patent No.: US 11,401,567 B2
(45) Date of Patent: Aug. 2, 2022

(54) MANUFACTURING METHOD OF STEEL SHEET

(71) Applicant: NIPPON STEEL CORPORATION, Tokyo (JP)

(72) Inventors: Toyomitsu Nakamura, Tokyo (JP); Kenichiro Matsumura, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 408 days.

(21) Appl. No.: 16/474,674

(22) PCT Filed: Mar. 24, 2017

(86) PCT No.: PCT/JP2017/012160
§ 371 (c)(1),
(2) Date: Jun. 28, 2019

(87) PCT Pub. No.: WO2018/173287
PCT Pub. Date: Sep. 27, 2018

(65) Prior Publication Data

US 2020/0190610 A1 Jun. 18, 2020

(51) Int. Cl.

| | |
|---|---|
| ***C21D 8/02*** | (2006.01) |
| ***B22D 11/00*** | (2006.01) |
| ***C22C 38/02*** | (2006.01) |
| ***C22C 38/04*** | (2006.01) |
| ***C23G 5/00*** | (2006.01) |

(52) U.S. Cl.
CPC ..... *C21D 8/0226* (2013.01); *B22D 11/001* (2013.01); *C21D 8/0236* (2013.01); *C21D 8/0273* (2013.01); *C22C 38/02* (2013.01); *C22C 38/04* (2013.01); *C23G 5/00* (2013.01)

(58) Field of Classification Search
CPC .. C21D 8/0226; C21D 8/0236; C21D 8/0273; C21D 1/74; C21D 8/0473; C21D 8/0478; C21D 9/48; B22D 11/001; C22C 38/02; C22C 38/04; C22C 38/06; C23G 5/00; C23G 1/08
See application file for complete search history.

(56) References Cited

U.S. PATENT DOCUMENTS

| | | | | |
|---|---|---|---|---|
| 4,437,947 | A | 3/1984 | Saito et al. | |
| 2009/0308498 | A1 | 12/2009 | Matsumura et al. | |
| 2013/0034745 | A1* | 2/2013 | Tachiki | C23C 28/021 428/679 |
| 2013/0149526 | A1* | 6/2013 | Masuoka | C23G 1/00 428/332 |
| 2015/0013716 | A1 | 1/2015 | Masuoka et al. | |
| 2015/0136278 | A1 | 5/2015 | Nakanishi et al. | |
| 2019/0003002 | A1* | 1/2019 | Seo | C22C 38/04 |

FOREIGN PATENT DOCUMENTS

| | | | |
|---|---|---|---|
| CN | 102041452 | A | 5/2011 |
| JP | 58-37391 | B2 | 8/1983 |
| JP | 3-20485 | A | 1/1991 |
| JP | 5-195239 | A | 8/1993 |
| JP | 2004-323969 | A | 11/2004 |
| JP | 2008-190030 | A | 8/2008 |
| JP | 2011-214137 | A | 10/2011 |
| JP | 2012-188693 | A | 10/2012 |
| JP | 5482968 | B2 | 5/2014 |
| KR | 10-2015-0032581 | A | 3/2015 |
| WO | WO 2013/108785 | A1 | 7/2013 |

OTHER PUBLICATIONS

International Preliminary Report on Patentability and English translation of the Written Opinion of the International Searching Authority, dated Oct. 3, 2019, for International Application No. PCT/JP2017/012160.

Liu et al., "Forming mechanism and counter measure of pitting on cold rolled continuous annealed strip steel surface", Heat Treatment of Metals, Sep. 2014, vol. 39, No. 9, pp. 147-150 (4 pages), with english abstract.

International Search Report for PCT/JP2017/012160 dated May 30, 2017.

Written Opinion of the International Searching Authority for PCT/JP2017/012160 (PCT/ISA/237) dated May 30, 2017.

Huang Xu, et al. "Causes of Adherends Forming on the Surface of Pickled Sheet and Counter Measures", Iron Steel Vanadium Titanium, vol. 20, No. 1, Mar. 1999, pp. 44-48.

* cited by examiner

*Primary Examiner* — John A Hevey
(74) *Attorney, Agent, or Firm* — Birch, Stewart, Kolasch & Birch, LLP

(57) ABSTRACT

A manufacturing method of a steel sheet includes: a step of performing continuous casting of molten steel having a Si content of 0.4 mass % to 3.0 mass % to obtain a slab; a step of performing hot rolling of the slab to obtain a hot-rolled steel sheet; a step of performing cold rolling of the hot-rolled steel sheet to obtain a cold-rolled steel sheet; a step of performing cold-rolled sheet annealing of the cold-rolled steel sheet; a step of performing pickling after the cold-rolled sheet annealing; a step of performing water washing after the pickling; and a step of performing drying after the water washing. A dew point is set to −35° C. or lower in the cold-rolled sheet annealing, an electrical conductivity of a rinse water to be used in the water washing is set to 5.0 mS/m or less, a water-washing time is set to 15 seconds or less in the water washing, and the drying is started within 60 seconds from an end of the water washing.

4 Claims, No Drawings

MANUFACTURING METHOD OF STEEL SHEET

TECHNICAL FIELD

The present invention relates to a manufacturing method of a steel sheet.

BACKGROUND ART

In recent years, from the viewpoint of protecting the global environment, an improvement in fuel consumption performance of an automobile is being demanded. Further, from the viewpoint of securing safety of occupants at a time of a collision, an improvement in safety of an automobile is also being demanded. In order to respond to these demands, it is desirable to achieve a reduction in weight of a vehicle body and high strengthening thereof at the same time, and in a cold-rolled steel sheet to become a raw material of automotive parts, thinning of the steel sheet is being advanced while holding high strength.

In such a high-strength steel sheet, a rust prevention property is demanded. Therefore, the steel sheet is subjected to conversion treatment or electrodeposition coating after press forming. However, in the conversion treatment, when a rust preventive oil coated for securing the rust prevention property during transportation or a lubricating oil in the press forming adheres to a surface of the steel sheet, the rust preventive oil or the lubricating oil inhibits a conversion reaction. For this reason, the rust preventive oil or the lubricating oil is degreased before performing the conversion treatment.

For an improvement in conversion treatability in the high-strength steel sheet, the steel sheet is sometimes subjected to Ni plating treatment. Further, also in a Si-containing steel sheet having no high strength, good conversion treatability is sometimes demanded, so that the steel sheet is sometimes subjected to the Ni plating treatment. On the other hand, when the steel sheet is subjected to the Ni plating treatment, degreasing ability deteriorates.

Various techniques have been proposed hitherto, but it is difficult that the conversion treatability and the degreasing ability are compatible with each other. In recent years, an improvement in surface conditioner to be used for the conversion treatment makes a desirable conversion film likely to be formed, so that a technique in which the Ni plating treatment is omitted is proposed. However, when the Ni plating treatment is omitted, the conversion treatability is not sufficient. Even such a technique makes it difficult to make the conversion treatability and the degreasing ability compatible with each other.

CITATION LIST

Patent Literature

Patent Literature 1: Japanese Examined Patent Application Publication No. 58-37391

Patent Literature 2: Japanese Laid-open Patent Publication No. 2012-188693

Patent Literature 3: Japanese Laid-open Patent Publication No. 2004-323969

Patent Literature 4: Japanese Patent No. 5482968

Patent Literature 5: International Publication Pamphlet No. WO 2013/108785

Patent Literature 6: Japanese Laid-open Patent Publication No. 2008-190030

Patent Literature 7: Japanese Laid-open Patent Publication No. 03-20485

SUMMARY OF INVENTION

Technical Problem

An object of the present invention is to provide a manufacturing method of a steel sheet capable of making conversion treatability and degreasing ability compatible with each other.

Solution to Problem

The present inventors have conducted keen studies in order to solve the above-described problem. As a result, it has become clear that when a Si content is 0.4 mass % or more, a Si oxide is formed on a surface of a steel sheet during cold-rolled sheet annealing, and this Si oxide reduces conversion treatability. The Si oxide can be removed by pickling, but it has also become clear that a Fe oxide film is generated to grow and remain on the surface of the steel sheet during water washing after the pickling by performing the pickling. Further, it has become clear that the thicker the Fe oxide film generated on the surface of the steel sheet is, the more the conversion treatability deteriorates. It is possible to improve the conversion treatability through Ni plating treatment, but as described above, performing the Ni plating treatment makes degreasing ability deteriorate. Thus, as a result of the studies conducted by the present inventors, it has become clear that when the Si content is 0.4 mass % or more, it is difficult that the conversion treatability and the degreasing ability are compatible with each other.

Thus, the present inventors have further conducted keen studies in order to suppress the generation of the Fe oxide film during the water washing after the pickling. As a result, they have found that the higher an electrical conductivity of a rinse water to be used in the water washing is, the thicker the Fe oxide film grows, and the longer a water-washing time is, the thicker the Fe oxide film grows. Further, they have found that the longer a time from an end of the water washing to a start of drying is, the thicker the Fe oxide film grows.

As a result of further repeating keen studies based on the above appreciation, the present inventors have conceived embodiments of the invention to be indicated below.

(1)

A manufacturing method of a steel sheet includes:

a step of performing continuous casting of molten steel having a Si content of 0.4 mass % to 3.0 mass % to obtain a slab;

a step of performing hot rolling of the slab to obtain a hot-rolled steel sheet;

a step of performing cold rolling of the hot-rolled steel sheet to obtain a cold-rolled steel sheet;

a step of performing cold-rolled sheet annealing of the cold-rolled steel sheet;

a step of performing pickling after the cold-rolled sheet annealing;

a step of performing water washing after the pickling; and a step of performing drying after the water washing, wherein a dew point is set to −35° C. or lower in the cold-rolled sheet annealing, wherein an electrical conductivity of a rinse water to be used in the water washing is set to 5.0 mS/m or less, wherein a water-washing time is set to 15 seconds or less in the water washing, and wherein the drying is started within 60 seconds from an end of the water washing.

(2)

The manufacturing method of the steel sheet according to (1), wherein a Mn content of the molten steel is 0.5 mass % to 4.0 mass %.

(3)

The manufacturing method of the steel sheet according to (1) or (2), wherein a formula 1 is satisfied:

$$349.81[H^+]+50.1[Na^+]+53.05\times2[Mg^{2+}]+73.5[K^+]+59.5\times2[Ca^{2+}]+53.5\times2[Fe^{2+}]+68.4\times3[Fe^{3+}]+76.35[Cl^-]+71.46[NO_3^-]+80.0\times2[SO_4^{2-}]\leq5/100 \quad \text{(formula 1)}$$

wherein when a concentration (mol/L) of $H^+$ is set as $[H^+]$, a concentration (mol/L) of $Na^+$ is set as $[Na^+]$, a concentration (mol/L) of $Mg^{2+}$ is set as $[Mg^{2+}]$, a concentration (mol/L) of $K^+$ is set as $[K^+]$, a concentration (mol/L) of $Ca^{2+}$ is set as $[Ca^{2+}]$, a concentration (mol/L) of $Fe^{2+}$ is set as $[Fe^{2+}]$, a concentration (mol/L) of $Fe^{3+}$ is set as $[Fe^{3+}]$, a concentration (mol/L) of $Cl^-$ is set as $[Cl^-]$, a concentration (mol/L) of $NO_3^-$ is set as $[NO_3^-]$, and a concentration (mol/L) of $SO_4^{2-}$ is set as $[SO_4^{2-}]$.

ADVANTAGEOUS EFFECTS OF INVENTION

According to the present invention, good conversion treatability can be obtained without performing Ni plating treatment, so that it is possible to make conversion treatability and degreasing ability compatible with each other.

DESCRIPTION OF EMBODIMENTS

Hereinafter, an embodiment of the present invention will be explained in detail. In a manufacturing method of a steel sheet according to this embodiment, continuous casting of molten steel, hot rolling, pickling after hot rolling, cold rolling, cold-rolled sheet annealing, pickling after annealing, water washing, drying, and so on are performed. In the following explanation, "%" which is a unit of a content of each of elements contained in the molten steel means "mass %" unless otherwise stated.

First, in the continuous casting of molten steel and the hot rolling, the continuous casting of molten steel having a Si content of 0.4% to 3.0% is performed to produce a slab, and heating and hot rolling of this slab are performed.

The continuous casting and the heating can be performed under typical conditions. As described above, when the Si content is 0.4% or more, a Si oxide is generated to the extent that pickling is required. When the Si content is more than 3.0%, a large amount of the Si oxide is formed on a surface of a steel sheet during the cold-rolled sheet annealing, and the Si oxide cannot be removed sufficiently even though the pickling is performed, so that it becomes difficult to secure conversion treatability. Accordingly, the Si content is set to 3.0% or less.

In the hot rolling, finish rolling is preferably performed in a temperature range of 850° C. to 1000° C. A coiling temperature of the obtained hot-rolled steel sheet is preferably set to a range of 550° C. to 750° C.

The pickling after hot rolling can be performed under typical conditions.

Next, the cold rolling of the obtained hot-rolled steel sheet is performed to obtain a cold-rolled steel sheet. When an attempt is made to set a rolling ratio of the cold rolling to less than 50%, there is a case where the hot-rolled steel sheet is to be made excessively thin in advance, so that production efficiency is reduced. Accordingly, the rolling ratio of the cold rolling is preferably set to 50% or more. An attempt to set the rolling ratio of the cold rolling to more than 85% sometimes makes a load at a time of the cold rolling remarkably increase. Accordingly, the rolling ratio of the cold rolling is preferably set to 85% or less. Note that the rolling ratio is a value calculated by (h1−h2)/h1 when a thickness of the steel sheet before the cold rolling is set as h1 and a thickness of the steel sheet after the cold rolling is set as h2.

Next, the cold-rolled sheet annealing of the obtained cold-rolled steel sheet is performed. The cold-rolled sheet annealing can be performed by using a continuous annealing furnace provided with, for example, a preheating chamber, a heating chamber, a soaking chamber, a cooling chamber and an overaging chamber.

A holding temperature of the cold-rolled sheet annealing is preferably set to 750° C. or higher, and a holding time thereof is preferably set to one minute or more. When the holding temperature of the cold-rolled sheet annealing is lower than 750° C. and the holding time thereof is less than one minute, desirable ductility and other mechanical properties cannot be sometimes obtained by recrystallization annealing.

An atmosphere in the annealing furnace has $N_2$ as a main body, and $H_2$ of 1 vol % to 40 vol % may be added thereto, or water vapor may be added thereto as necessary. The atmosphere in the annealing furnace contains $H_2O$ and other impurity gases which are inevitably mixed therein.

When a dew point of an atmosphere gas in the annealing furnace is higher than −35° C., a surface layer of the steel sheet is inevitably decarburized, and the mechanical properties of the steel sheet deteriorate. Accordingly, the dew point of the atmosphere gas in the annealing furnace is set to −35° C. or lower. Water vapor may be added in the annealing furnace, and a water vapor amount at the above time is about 0.03 vol %, considering that an equilibrium vapor pressure of $H_2O$ at −35° C. is $3.2\times10^{-4}$ atmosphere and that a total pressure of the atmosphere gas in the annealing furnace is normally equal to an atmospheric pressure. Water vapor is sometimes inevitably mixed in the annealing furnace, and a water vapor amount at the above time is about 0.02 vol %. When the water vapor is inevitably mixed, the dew point of the atmosphere gas in the annealing furnace is about −40° C.

The pickling is performed after the cold-rolled sheet annealing. By performing the pickling, a Si oxide or a Mn oxide formed on the surface of the steel sheet during the cold-rolled sheet annealing is removed. Regarding a method of the pickling, which is not particularly limited, for example, the steel sheet after the cold-rolled sheet annealing is immersed continuously while being conveyed in a pickling bath filled with a pickling solution, thereby allowing the pickling to be performed.

As the pickling solution, which is not particularly limited, it is possible to use a solution containing a hydrochloric acid, a sulfuric acid or a nitric acid or a combination of these by 1 mass % to 20 mass % in total. It is sufficient that a temperature of the pickling solution, which is not particularly limited, is 30° C. to 90° C. It is sufficient that an immersion time during which the steel sheet is immersed in the pickling solution, which is not particularly limited, is 2 seconds to 20 seconds.

Next, the steel sheet after the pickling is subjected to the water washing. Regarding a method of the water washing, which is not particularly limited, for example, the steel sheet after the pickling is immersed continuously while being conveyed in a bath filled with a rinse water to be used for the water washing, thereby allowing the water washing to be performed.

When an electrical conductivity of the rinse water is more than 5.0 mS/m, a Fe oxide film is likely to grow on the surface of the steel sheet during the water washing, so that excellent conversion treatability cannot be obtained. Accordingly, the electrical conductivity of the rinse water is set to 5.0 mS/m or less, and preferably set to 1.0 mS/m or less. The lower the electrical conductivity of the rinse water is, the more the growth of the Fe oxide film can be suppressed, so that the conversion treatability is easily secured. On the other hand, even in theoretically pure water, $10^7$ mol/L of each of $H^+$ ions and $OH^-$ ions caused by self-dissociation exists in the water. Further, based on a literature (Denki kagaku gairon, MATSUDA Yoshiharu, IWAKURA Chiaki, Maruzen, Tokyo, 1994, p. 15), molar electrical conductivities of $H^+$ ions and $OH^-$ ions are 349.81 $S \cdot cm^2/mol$ and 198.3 $S \cdot cm^2/mol$ respectively. From the above, it is assumed that an electrical conductivity of the theoretically pure water is 5.4 μS/m. Accordingly, it is impossible to set the electrical conductivity of the rinse water to less than 5.4 μS/m. For example, maintaining a low electrical conductivity such as less than 10 μS/m forces not only ultrapure water to be used, but also a rise in electrical conductivity due to occurrence of carbonate ions by dissolution of carbon dioxide into the water from in the air to be prevented. For this reason, an atmosphere is required to be controlled, which is not economical. Accordingly, setting the electrical conductivity of the rinse water to less than 10 μS/m causes unnecessarily excessive costs, which is therefore not preferable.

When a water-washing time is more than 15 seconds, the Fe oxide film is likely to grow on the surface of the steel sheet during the water washing, so that the excellent conversion treatability cannot be obtained. Accordingly, the water-washing time is set to 15 seconds or less, and preferably set to 5 seconds or less. When the water-washing time is less than one second, the acid cannot be removed by the water washing, the acid remaining on the steel sheet elutes $Fe^{2+}$ ions from the steel sheet, and the $Fe^{2+}$ ions react with ambient oxygen to form the Fe oxide film thick, which therefore causes a deterioration in conversion treatability or discoloration of a product appearance to yellow. Accordingly, the water-washing time is preferably set to one second or more.

The Si oxide is formed on the surface of the steel sheet during the cold-rolled sheet annealing by Si, so that the conversion treatability is made to deteriorate. Even though this Si oxide can be removed by the pickling, Si solid-dissolved in the steel sheet also makes the conversion treatability deteriorate. The conversion treatability depends on the Si content in the steel sheet. The larger the Si content in the steel sheet is, the more likely the conversion treatability is to deteriorate, so that it is preferable that according to the Si content in the steel sheet, the electrical conductivity of the rinse water is controlled to be low and the water-washing time is controlled to be short.

Table 1 presents the relationships between the Si content in the steel sheet, and the electrical conductivity of the rinse water and the water-washing time. When the Si content in the steel sheet is 0.4% or more and less than 1.25%, the electrical conductivity of the rinse water is preferably set to 5.0 mS/m or less, and the water-washing time is preferably set to 15 seconds or less. When the Si content in the steel sheet is 1.25% or more and less than 2.5%, the electrical conductivity of the rinse water is preferably set to 3.0 mS/m or less, and the water-washing time is preferably set to 9 seconds or less. When the Si content in the steel sheet is not less than 2.5% nor more than 3.0%, the electrical conductivity of the rinse water is preferably set to 1.0 mS/m or less, and the water-washing time is preferably set to 3 seconds or less. Controlling the electrical conductivity of the rinse water and the water-washing time as described above makes it possible to sufficiently secure the conversion treatability.

TABLE 1

| Si CONTENT (MASS %) | ELECTRICAL CONDUCTIVITY (mS/m) | WATER-WASHING TIME (SECOND) |
|---|---|---|
| 0.4-1.25 | 5.0 OR LESS | 15 OR LESS |
| 1.25-2.5 | 3.0 OR LESS | 9 OR LESS |
| 2.5-3.0 | 1.0 OR LESS | 3 OR LESS |

The rinse water to be used for the water washing can contain $Na^+$, $Mg^{2+}$, $K^+$, and $Ca^{2+}$ derived from components of rocks present in river basins of water resources, and contain $H^+$, $Fe^{2+}$, $Fe^{3+}$, $Cl^-$, $NO_3^-$, and $SO_4^{2-}$ mixed by performing the pickling. The electrical conductivity of the rinse water depends on ion concentrations of these, and can be calculated by obtaining products of the ion concentrations (mol/L) and electrical conductivities per 1 mole regarding the respective ions and summing up these products in the respective ions. That is, when a concentration (mol/L) of $H^+$, a concentration (mol/L) of $Na^+$, a concentration (mol/L) of $Mg^{2+}$, a concentration (mol/L) of $K^+$, a concentration (mol/L) of $Ca^{2+}$, a concentration (mol/L) of $Fe^{2+}$, a concentration (mol/L) of $Fe^{3+}$, a concentration (mol/L) of $Cl^-$, a concentration (mol/L) of $NO_3^-$, and a concentration (mol/L) of $SO_4^{2-}$, which are contained in the rinse water, are set as $[H^+]$, $[Na^+]$, $[Mg^{2+}]$, $[K^+]$, $[Ca^{2+}]$, $[Fe^{2+}]$, $[Fe^{3+}]$, $[Cl^-]$, $[NO_3^-]$, and $[SO_4^{2-}]$, a formula 1 is preferably satisfied. Based on the literature (Denki kagaku gairon, MATSUDA Yoshiharu, IWAKURA Chiaki, Maruzen, Tokyo, 1994, p. 15), electrical conductivities per 1 mol/L of the respective ion species are $H^+$: 349.81 ($S \cdot cm^2/mol$), $Na^+$: 50.1 ($S \cdot cm^2/mol$), $Mg^{2+}$: 53.05×2 ($S \cdot cm^2/mol$), $K^+$: 73.5 ($S \cdot cm^2/mol$), $Ca^{2+}$: 59.5×2 ($S \cdot cm^2/mol$), $Fe^{2+}$: 53.5×2 ($S \cdot cm^2/mol$), $Fe^{3+}$: 68.4×3 ($S \cdot cm^2/mol$), $Cl^-$: 76.35 ($S \cdot cm^2/mol$), $NO_3^-$: 71.46 ($S \cdot cm^2/mol$), and $SO_4^{2-}$: 80.0×2 ($S \cdot cm^2/mol$). Accordingly, the electrical conductivity of the rinse water can be calculated by the formula 1. Note that 1 ($S \cdot cm^2/mol$) is converted into 100 ($mS \cdot l/m \cdot mol$).

$$349.81[H^+]+50.1[Na^+]+53.05\times2[Mg^{2+}]+73.5[K^+]+59.5\times2[Ca^{2+}]+53.5\times2[Fe^{2+}]+68.4\times3[Fe^{3+}]+76.35[Cl^-]+71.46[NO_3^-]+80.0\times2[SO_4^{2-}]\leq5/100 \quad \text{(formula 1)}$$

The reason why the higher the electrical conductivity of the rinse water is, the more likely the Fe oxide film is to be formed on the surface of the steel sheet during the water washing is as follows. During the water washing, Fe derived from a component of the steel sheet is eluted into the rinse water as the $Fe^{2+}$ ion by the following anode reaction.

$$Fe \rightarrow Fe^{2+}+2e^-$$

On the other hand, oxygen in the air dissolves in the rinse water to thereby cause the following cathode reaction, which generates $OH^-$ ions.

$$\frac{1}{2}O_2+H_2O+2e^- \rightarrow 2OH^-$$

Thereafter, $Fe^{2+}$ and $2OH^-$ are bonded to each other in the rinse water, and precipitate as iron hydroxide ($Fe(OH)_2$).

The oxide film of FeO is formed by desorption of $H_2O$ from the iron hydroxide.

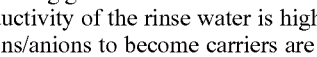

$$Fe^{2+}+2OH^- \rightarrow Fe(OH)_2$$

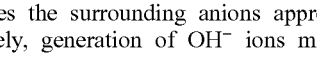

$$Fe(OH)_2 \rightarrow FeO+H_2O$$

In this series of reactions, when the electrical conductivity of the rinse water is low, in the vicinities of $Fe^{2+}$ ions and $OH^-$ ions generated in the rinse water, in each of which positive charge/negative charge becomes excessive, $Fe^{2+}$ ions and $OH^-$ ions having equal to or more than predetermined amounts are therefore considered to be prevented from being generated. On the other hand, when the electrical conductivity of the rinse water is high, a number of various cations/anions to become carriers are contained in the rinse water, so that it is considered that generation of the $Fe^{2+}$ ions makes the surrounding anions approach them, and conversely, generation of $OH^-$ ions makes the surrounding cations approach them, thereby maintaining an electrically neutral state and promoting the above-described series of reactions. From the above, the longer the water-washing time is, the more the above-described series of reactions is promoted, so that the Fe oxide film is presumed to be likely to be formed on the surface of the steel sheet.

The steel sheet after the water washing may be pressed down by, for example, a wringer roll normally made of rubber. It is possible to scrape the rinse water adhering to the surface of the steel sheet after the water washing. Reducing an amount of the rinse water adhering to the surface of the steel sheet after the water washing makes it possible to reduce energy and time required for the following drying.

Next, the steel sheet after the water washing is dried. Regarding a method of the drying, which is not particularly limited, for example, the steel sheet after the water washing is placed so as to be along a conveying direction, and hot air is blown to the steel sheet which is being conveyed with a dryer, thereby allowing the drying to be performed. Note that regarding drying performance of the dryer (blower), which is not particularly limited, it is sufficient that the dryer can dry the steel sheet sufficiently in consideration of a speed at which the steel sheet is conveyed.

The drying is started within 60 seconds from an end of the water washing. When a time from the end of the water washing to a start of the drying is more than 60 seconds, the Fe oxide film is generated on the surface of the steel sheet, and the conversion treatability deteriorates, resulting in a deterioration in surface appearance of the steel sheet. Granted that the rinse water to be used in the water washing is clean, in a case where fixed time passes with the rinse water remaining adhering to the surface of the steel sheet, there is the possibility that the Fe oxide film is generated on the surface of the steel sheet.

During the water washing of the steel sheet, there occur the anode reaction in which the $Fe^{2+}$ ion is eluted from Fe derived from the component of the steel sheet into the rinse water and the cathode reaction in which oxygen in the air dissolves in the rinse water to generate $OH^-$ ions. These reactions progress even between from the completion of the water washing to the start of the drying, so that an amount of the Fe oxide film to be generated is presumed to increase.

Thus, the steel sheet according to this embodiment can be manufactured. Note that after the drying, the steel sheet may be coiled in a coil shape. Before coiling it in a coil shape, the steel sheet may be coated with an antirust. A coating film formed on the surface of the steel sheet by the antirust protects the surface of the steel sheet from ambient moisture and oxygen in the air, so that the generation of the Fe oxide film can be suppressed. This makes it possible to secure the conversion treatability of the steel sheet and hold the surface appearance of the steel sheet beautiful.

From the above, according to the manufacturing method of the steel sheet according to this embodiment, good conversion treatability can be obtained without performing Ni plating treatment, so that it is possible to make conversion treatability and degreasing ability compatible with each other. Concretely, in the manufacturing method of the steel sheet according to this embodiment, by controlling the electrical conductivity of the rinse water, the water-washing time, and the time from the water washing end to the drying start, it is possible to suppress the generation and the growth of the Fe oxide film which can be generated on the surface of the steel sheet at the time of the water washing and after the water washing end. This makes it possible to secure the conversion treatability of the steel sheet stably and omit the Ni plating treatment for securing the conversion treatability. Moreover, in the manufacturing method of the steel sheet according to this embodiment, by controlling the dew point at the time of the cold-rolled sheet annealing, it is possible to suppress a deterioration in mechanical properties caused by inevitable decarburization on a surface layer of the steel sheet.

The steel sheets which can be manufactured by this embodiment are various, and for example, a high-strength steel sheet and a Si-containing steel sheet having no high strength can be manufactured by this embodiment.

When the high-strength steel sheet is manufactured, molten steel has a chemical composition represented by, for example, C: 0.05% to 0.25%, Si: 0.4% to 3.0%, Mn: 0.5% to 4.0%, Al: 0.005% to 0.1%, P: 0.03% or less, S: 0.02% or less, Ni, Cu, Cr or Mo: 0.0% to 1.0%, and a total content of Ni, Cu, Cr and Mo: 0.0% to 3.5% in total, B: 0.0000% to 0.005%, Ti, Nb or V: 0.000% to 0.1%, and a total content of Ti, Nb and V: 0.0% to 0.20% in total, and the balance: Fe and impurities. As the impurities, the ones contained in raw materials such as ore and scrap and the ones contained in a manufacturing process are exemplified.

(C: 0.05% to 0.25%)

C secures strength of the steel sheet by structure strengthening due to generation of a martensite phase at a time of rapid cooling, or the like. When the C content is less than 0.05%, the martensite phase is not generated sufficiently under normal annealing conditions, and it is sometimes difficult to secure the strength. Accordingly, the C content is preferably set to 0.05% or more. When the C content is more than 0.25%, sufficient spot weldability cannot be sometimes secured. Accordingly, the C content is preferably set to 0.25% or less.

(Si: 0.4% to 3.0%)

Si improves the strength while suppressing a deterioration in ductility of the steel sheet. In order to obtain an action and effect thereof sufficiently, the Si content is set to 0.4% or more. When the Si content is more than 3.0%, workability at the time of the cold rolling is sometimes reduced. Accordingly, the Si content is set to 3.0% or less.

(Mn: 0.5% to 4.0%)

Mn improves hardenability of the steel to secure the strength. In order to obtain an action and effect thereof sufficiently, the Mn content is preferably set to 0.5% or more. When the Mn content is more than 4.0%, workability at the time of the hot rolling deteriorates, which sometimes causes a crack of steel in the continuous casting and the hot rolling.

Accordingly, the Mn content is preferably set to 4.0% or less.

(Al: 0.005% to 0.1%) Al is a deoxidizing element of the steel. Further, Al forms AlN to suppress grain refining of crystal grains and suppress that heat treatment makes crystal grains coarse, which secures the strength of the steel sheet. When the Al content is less than 0.005%, an effect thereof is hard to obtain. Accordingly, the Al content is preferably set to 0.005% or more. When the Al content is more than 0.1%, weldability of the steel sheet sometimes deteriorates. Accordingly, the Al content is preferably set to 0.1% or less. In order to make surface defects on the steel sheet due to alumina clusters less likely to occur, the Al content is more preferably set to 0.08% or less.

(P: 0.03% or Less)

P increases the strength of the steel. Accordingly, P may be contained. Because refining costs become considerable, the P content is preferably set to 0.001% or more, and more preferably set to 0.005% or more. When the P content is more than 0.03%, the workability is sometimes reduced. Accordingly, the P content is preferably set to 0.03% or less, and more preferably set to 0.02% or less.

(S: 0.02% or Less)

S is contained as an impurity in the steel in a normal steelmaking method. When the S content is more than 0.02%, the workability at the time of the hot rolling of the steel is made to deteriorate, and further coarse MnS to become a starting point of a fracture at a time of bending or hole expanding is formed, so that the workability is sometimes made to deteriorate. Accordingly, the S content is preferably set to 0.02% or less. When the S content is less than 0.0001%, costs become considerable, and therefore the S content is preferably set to 0.0001% or more. In order to make surface defects on the steel sheet less likely to occur, the S content is more preferably set to 0.001% or more.

Ni, Cu, Cr, Mo, B, Ti, Nb and V are not essential elements, but optional elements which may be each contained appropriately in the steel sheet within a limit of a predetermined amount.

(Ni, Cu, Cr or Mo: 0.0% to 1.0%, and total content of Ni, Cu, Cr and Mo: 0.0% to 3.5% in total)

Ni, Cu, Cr and Mo retard generation of carbide to contribute to retention of austenite. Further, they lower a martensite transformation start temperature of austenite. This improves workability or fatigue strength. Accordingly, Ni, Cu, Cr or Mo may be contained. In order to obtain an effect thereof sufficiently, the content of Ni, Cu, Cr or Mo is preferably set to 0.05% or more. When the content of Ni, Cu, Cr or Mo is more than 1.0%, an improvement effect of the strength is saturated, and the ductility remarkably deteriorates. Accordingly, the content of Ni, Cu, Cr or Mo is preferably set to 1.0% or less. Further, when the total content of Ni, Cu, Cr and Mo is more than 3.5%, more hardenability of the steel improves than required, so that manufacture of a steel sheet having ferrite as a main body and having good workability becomes difficult, and costs rise. Accordingly, the total content of Ni, Cu, Cr and Mo is preferably set to 3.5% or less in total.

(B: 0.0000% to 0.005%)

B improves the hardenability of the steel. Further, on the occasion of reheating for alloying treatment, B delays a pearlite transformation and a bainite transformation. Accordingly, B may be contained. In order to obtain an effect thereof sufficiently, the B content is preferably set to 0.0001% or more. When the B content is more than 0.005%, on the occasion of cooling from a temperature zone where two phases of ferrite and austenite coexist with each other, ferrite having a sufficient area ratio does not grow, and the manufacture of the steel sheet having ferrite as the main body and having the good workability becomes difficult. Accordingly, the B content is preferably set to 0.005% or less, and more preferably set to 0.002% or less.

(Ti, Nb or V: 0.000% to 0.1%, and Total Content of Ti, Nb and V: 0.0% to 0.20% in Total)

Ti, Nb and V form carbide and nitride (or carbonitride), and impart high strength to the steel sheet in order to strengthen the ferrite phase. Accordingly, Ti, Nb or V may be contained. In order to obtain an effect thereof sufficiently, the content of Ti, Nb or V is preferably set to 0.001% or more. When the content of Ti, Nb or V is more than 0.1%, not only the costs rise, but also the improvement effect of the strength is saturated, and moreover, C is unnecessarily wasted. Accordingly, the content of Ti, Nb or V is preferably set to 0.1% or less. Further, when the total content of Ti, Nb and V is more than 0.20%, not only the costs rise, but also the improvement effect of the strength is saturated, and moreover, C is unnecessarily wasted. Accordingly, the total content of Ti, Nb and V is preferably set to 0.20% or less.

When the Si-containing steel sheet having no high strength is manufactured, molten steel has a chemical composition represented by, for example, C: 0.15% or less, Si: 0.4% to 1.0%, Mn: 0.6% or less, Al: 1.0% or less, P: 0.100% or less, S: 0.035% or less, and the balance: Fe and impurities. As the impurities, the ones contained in the raw materials such as ore and scrap and the ones contained in a manufacturing process are exemplified.

(C: 0.15% or Less)

C is contained in the steel by reducing iron ore by using coke in pig-iron making, and is a residue in which removal has not yet been completed by primary refining in steelmaking, but sometimes secures the strength of the steel sheet. The C content is preferably set to 0.15% or less in reference to JIS G 3141.

(Si: 0.4% to 1.0%)

Si sometimes improves the strength while suppressing the deterioration in ductility of the steel sheet. Further, Si is bonded to oxygen in the steel in refining of the steel, and also sometimes suppresses occurrence of air bubbles when steel ingot is solidified. In order to obtain an action and effect thereof sufficiently, the Si content is set to 0.4% or more. An upper limit value of the Si content is preferably set to 1.0% or less.

(Mn: 0.6% or Less)

Mn is contained in order to remove S in the refining of the steel, and sometimes secures the strength of the steel sheet. The Mn content is preferably set to 0.6% or less in reference to JIS G 3141.

(Al: 1.0% or Less)

Al is a deoxidizing element of the steel. Further, Al forms AlN to suppress grain refining of crystal grains and suppress that the heat treatment makes crystal grains coarse, which secures the strength of the steel sheet. An upper limit value of the Al content is preferably set to 1.0% or less.

(P: 0.100% or Less)

P derives from iron ore, and is a residue in which removal has not yet been completed by the primary refining in the steelmaking, but sometimes increases the strength of the steel. The P content is preferably set to 0.100% or less in reference to JIS G 3141.

(S: 0.035% or Less)

S is contained as an impurity in the steel in the normal steelmaking method. The S content is preferably set to 0.035% or less in reference to JIS G 3141.

As further necessary, the Si-containing steel sheet having no high strength may contain alloying elements other than the above-described elements.

The above is a detailed explanation of an embodiment suitable for the present invention, but the present invention is not limited to such an example. It is obvious that persons having normal knowledge in the technical field belonging to the present invention can conceive various modified examples or corrected examples within the category of the technical spirit described in the claims, and it is understood that these also naturally belong to the technical scope of the present invention.

EXAMPLE

Next, examples of the present invention will be explained. Conditions in examples are condition examples employed for confirming the applicability and effects of the present invention and the present invention is not limited to these examples. The present invention can employ various conditions as long as the object of the present invention is achieved without departing from the spirit of the present invention.

Example 1

A steel type A to a steel type E presented in Table 2 were cast to produce slabs, and the respective slabs were subjected to hot rolling by a conventional means to obtain hot-rolled steel sheets. The obtained hot-rolled steel sheets were subjected to pickling and thereafter subjected to cold rolling to obtain cold-rolled steel sheets. The obtained cold-rolled steel sheets were each cut into 100 mm×50 mm.

TABLE 2

| | CHEMICAL COMPOSITION (MASS %) | | | | | |
|---|---|---|---|---|---|---|
| STEEL TYPE | C | Si | Mn | P | S | Al |
| A | 0.1 | 0.45 | 2.2 | 0.008 | 0.005 | 0.003 |
| B | 0.2 | 1.3 | 2.6 | 0.008 | 0.005 | 0.003 |
| C | 0.3 | 2.6 | 4.0 | 0.008 | 0.005 | 0.003 |
| D | 0.002 | <0.01 | 0.1 | 0.008 | 0.005 | 0.003 |
| E | 0.25 | 3.5 | 5.5 | 0.008 | 0.005 | 0.003 |

Next, the obtained cold-rolled steel sheets were subjected sequentially to cold-rolled sheet annealing, pickling, water washing and drying under conditions presented in Table 3 to Table 11. Regarding the cold-rolled sheet annealing, a continuous annealing simulation apparatus was used, and an annealing temperature was set to 800° C. Underlines in Table 3 to Table 11 indicate that numerical values thereon deviate from ranges of the present invention.

TABLE 3

| | | ANNEALING | PICKLING | | | WATER WASHING | | | | |
|---|---|---|---|---|---|---|---|---|---|---|
| | | | | | | | | WATER | | |
| TEST No. | STEEL TYPE | DEW POINT (° C.) | PICKLING SOLUTION | TEMPERATURE (° C.) | IMMERSION TIME (SECOND) | PRESENCE/ ABSENCE | CONDUCTIVITY (mS/m) | FORMULA 1 | VOLUME DENSITY (L/s · m$^2$) | WATER TEMPERATURE (° C.) |
| 1 | A | −40 | ABSENCE | ABSENCE | ABSENCE | ABSENCE | — | — | — | — |
| 2 | B | −40 | ABSENCE | ABSENCE | ABSENCE | ABSENCE | — | — | — | — |
| 3 | A | −15 | ABSENCE | ABSENCE | ABSENCE | ABSENCE | — | — | — | — |
| 4 | A | −40 | HYDROCHLORIC ACID | 60 | 10 | PRESENCE | 0.22 | E | 23 | 18 |
| 5 | A | −40 | HYDROCHLORIC ACID | 60 | 10 | PRESENCE | 0.22 | E | 23 | 18 |
| 6 | A | −40 | HYDROCHLORIC ACID | 60 | 10 | PRESENCE | 0.22 | E | 23 | 18 |
| 7 | A | −40 | HYDROCHLORIC ACID | 60 | 10 | PRESENCE | 2.9 | E | 23 | 18 |
| 8 | A | −40 | HYDROCHLORIC ACID | 60 | 10 | PRESENCE | 2.9 | E | 23 | 18 |
| 9 | A | −40 | HYDROCHLORIC ACID | 60 | 10 | PRESENCE | 2.9 | E | 23 | 18 |
| 10 | A | −40 | HYDROCHLORIC ACID | 60 | 10 | PRESENCE | 33 | W | 23 | 18 |
| 11 | A | −40 | HYDROCHLORIC ACID | 60 | 10 | PRESENCE | 33 | W | 23 | 18 |
| 12 | A | −40 | HYDROCHLORIC ACID | 60 | 10 | PRESENCE | 136 | W | 23 | 18 |
| 13 | A | −40 | HYDROCHLORIC ACID | 60 | 10 | PRESENCE | 136 | W | 23 | 18 |
| 14 | A | −40 | HYDROCHLORIC ACID | 60 | 10 | PRESENCE | 1241 | W | 23 | 18 |
| 15 | A | −40 | HYDROCHLORIC ACID | 60 | 10 | PRESENCE | 1241 | W | 23 | 18 |
| 16 | A | −40 | HYDROCHLORIC ACID | 60 | 10 | PRESENCE | 2.9 | E | 23 | 18 |
| 17 | A | −40 | HYDROCHLORIC ACID | 60 | 10 | PRESENCE | 2.9 | E | 23 | 18 |
| 18 | A | −40 | HYDROCHLORIC ACID | 60 | 10 | PRESENCE | 2.9 | E | 23 | 18 |
| 19 | A | −40 | HYDROCHLORIC ACID | 60 | 10 | PRESENCE | 2.9 | E | 23 | 18 |
| 20 | A | −40 | HYDROCHLORIC ACID | 60 | 10 | PRESENCE | 33 | W | 23 | 18 |
| 21 | A | −40 | HYDROCHLORIC ACID | 60 | 10 | PRESENCE | 33 | W | 23 | 18 |
| 22 | A | −40 | HYDROCHLORIC ACID | 60 | 10 | PRESENCE | 0.22 | E | 23 | 18 |
| 23 | A | −35 | HYDROCHLORIC ACID | 60 | 10 | PRESENCE | 0.22 | E | 23 | 18 |
| 24 | A | −33 | HYDROCHLORIC ACID | 60 | 10 | PRESENCE | 0.22 | E | 23 | 18 |
| 25 | A | −49 | HYDROCHLORIC ACID | 57 | 12 | PRESENCE | 4.5 | E | 23 | 18 |
| 26 | A | −53 | HYDROCHLORIC ACID | 56 | 10 | PRESENCE | 5.0 | E | 23 | 18 |
| 27 | A | −43 | HYDROCHLORIC ACID | 41 | 16 | PRESENCE | 5.2 | W | 23 | 18 |
| 28 | A | −47 | HYDROCHLORIC ACID | 78 | 8 | PRESENCE | 5.5 | W | 23 | 18 |
| 29 | A | −44 | HYDROCHLORIC ACID | 65 | 12 | PRESENCE | 2.9 | E | 23 | 18 |
| 30 | A | −52 | HYDROCHLORIC ACID | 53 | 13 | PRESENCE | 2.9 | E | 23 | 18 |
| 31 | A | −41 | HYDROCHLORIC ACID | 50 | 10 | PRESENCE | 2.9 | E | 23 | 18 |
| 32 | A | −54 | HYDROCHLORIC ACID | 70 | 17 | PRESENCE | 2.9 | E | 23 | 18 |
| 33 | A | −46 | HYDROCHLORIC ACID | 83 | 14 | PRESENCE | 2.9 | E | 23 | 18 |
| 34 | A | −54 | HYDROCHLORIC ACID | 73 | 13 | PRESENCE | 2.9 | E | 23 | 18 |
| 35 | A | −40 | SULFURIC ACID | 48 | 16 | ABSENCE | — | — | — | — |
| 36 | A | −40 | SULFURIC ACID | 41 | 5 | PRESENCE | 0.22 | E | 23 | 18 |
| 37 | A | −47 | SULFURIC ACID | 78 | 9 | PRESENCE | 2.9 | E | 23 | 18 |
| 38 | A | −45 | SULFURIC ACID | 74 | 5 | PRESENCE | 4.5 | E | 23 | 18 |
| 39 | A | −48 | SULFURIC ACID | 48 | 17 | PRESENCE | 5.0 | E | 23 | 18 |
| 40 | A | −43 | SULFURIC ACID | 39 | 12 | PRESENCE | 5.2 | W | 23 | 18 |
| 41 | A | −48 | SULFURIC ACID | 63 | 15 | PRESENCE | 5.5 | W | 23 | 18 |
| 42 | A | −47 | SULFURIC ACID | 44 | 11 | PRESENCE | 2.9 | E | 23 | 18 |
| 43 | A | −50 | SULFURIC ACID | 74 | 12 | PRESENCE | 2.9 | E | 23 | 18 |

TABLE 3-continued

| | | | | | | | | | | |
|---|---|---|---|---|---|---|---|---|---|---|
| 44 | A | −49 | SULFURIC ACID | 50 | 11 | PRESENCE | 2.9 | E | 23 | 18 |
| 45 | A | −55 | SULFURIC ACID | 56 | 12 | PRESENCE | 2.9 | E | 23 | 18 |
| 46 | A | −46 | SULFURIC ACID | 66 | 9 | PRESENCE | 2.9 | E | 23 | 18 |
| 47 | A | −41 | SULFURIC ACID | 43 | 8 | PRESENCE | 2.9 | E | 23 | 18 |
| 48 | A | −48 | SULFURIC ACID | 47 | 13 | PRESENCE | 2.9 | E | 23 | 18 |
| 49 | A | −51 | SULFURIC ACID | 44 | 18 | PRESENCE | 2.9 | E | 23 | 18 |
| 50 | A | −49 | SULFURIC ACID | 49 | 11 | PRESENCE | 2.9 | E | 23 | 18 |
| 51 | A | −48 | SULFURIC ACID | 33 | 7 | PRESENCE | 2.9 | E | 23 | 18 |
| 52 | A | −53 | SULFURIC ACID | 36 | 14 | PRESENCE | 2.9 | E | 23 | 18 |
| 53 | A | −43 | SULFURIC ACID | 74 | 13 | PRESENCE | 2.9 | E | 23 | 18 |
| 54 | A | −49 | SULFURIC ACID | 76 | 14 | PRESENCE | 2.9 | E | 23 | 18 |
| 55 | A | −50 | SULFURIC ACID | 54 | 15 | PRESENCE | 2.9 | E | 23 | 18 |

| | WATER WASHING | DRYING | | | | EVALUATION | | | |
|---|---|---|---|---|---|---|---|---|---|
| TEST No. | WATER WASHING TIME (SECOND) | TIME TO DRYING START (SECOND) | DRYING TEMPERATURE (° C.) | Ni PLATING | THICKNESS OF OXIDE FILM (μm) | CONVERSION TREATABILITY | THICKNESS OF DECARBURIZED LAYER | DECREASING ABILITY | REMARK |
| 1 | — | — | — | ABSENCE | 37 | W | E | E | COMPARATIVE EXAMPLE |
| 2 | — | — | — | ABSENCE | 37 | M | E | E | COMPARATIVE EXAMPLE |
| 3 | — | — | — | ABSENCE | 48 | M | W | E | COMPARATIVE EXAMPLE |
| 4 | 3 | 0 | 40 | ABSENCE | 24 | E | E | E | INVENTION EXAMPLE |
| 5 | 10 | 0 | 40 | ABSENCE | 29 | E | E | E | INVENTION EXAMPLE |
| 6 | 50 | 0 | 40 | ABSENCE | 45 | W | E | E | COMPARATIVE EXAMPLE |
| 7 | 3 | 0 | 40 | ABSENCE | 37 | E | E | E | INVENTION EXAMPLE |
| 8 | 10 | 0 | 40 | ABSENCE | 39 | M | E | E | INVENTION EXAMPLE |
| 9 | 30 | 0 | 40 | ABSENCE | 49 | W | E | E | INVENTION EXAMPLE |
| 10 | 10 | 0 | 40 | ABSENCE | 49 | W | E | E | COMPARATIVE EXAMPLE |
| 11 | 30 | 0 | 40 | ABSENCE | 59 | W | E | E | COMPARATIVE EXAMPLE |
| 12 | 10 | 0 | 40 | ABSENCE | 56 | W | E | E | COMPARATIVE EXAMPLE |
| 13 | 30 | 0 | 40 | ABSENCE | 66 | W | E | E | COMPARATIVE EXAMPLE |
| 14 | 10 | 0 | 40 | ABSENCE | 68 | W | E | E | COMPARATIVE EXAMPLE |
| 15 | 30 | 0 | 40 | ABSENCE | 75 | W | E | E | COMPARATIVE EXAMPLE |
| 16 | 30 | 0 | 40 | ABSENCE | 48 | W | E | E | COMPARATIVE EXAMPLE |
| 17 | 10 | 15 | 40 | ABSENCE | 41 | M | E | E | INVENTION EXAMPLE |
| 18 | 10 | 120 | 40 | ABSENCE | 61 | W | E | E | COMPARATIVE EXAMPLE |
| 19 | 10 | 180 | 40 | ABSENCE | 74 | W | E | E | COMPARATIVE EXAMPLE |
| 20 | 10 | 45 | 40 | ABSENCE | 59 | W | E | E | COMPARATIVE EXAMPLE |
| 21 | 30 | 45 | 40 | ABSENCE | 69 | W | E | E | COMPARATIVE EXAMPLE |
| 22 | 3 | 0 | 40 | PRESENCE | 24 | E | E | W | COMPARATIVE EXAMPLE |
| 23 | 3 | 0 | 40 | ABSENCE | 26 | E | M | E | INVENTION EXAMPLE |
| 24 | 3 | 0 | 40 | ABSENCE | 24 | E | W | E | COMPARATIVE EXAMPLE |
| 25 | 3 | 0 | 40 | ABSENCE | 39 | M | E | E | INVENTION EXAMPLE |
| 26 | 3 | 0 | 40 | ABSENCE | 36 | M | E | E | INVENTION EXAMPLE |
| 27 | 3 | 0 | 40 | ABSENCE | 39 | W | E | E | COMPARATIVE EXAMPLE |
| 28 | 3 | 0 | 40 | ABSENCE | 37 | W | E | E | COMPARATIVE EXAMPLE |
| 29 | 15 | 50 | 40 | ABSENCE | 52 | M | E | E | INVENTION EXAMPLE |
| 30 | 17 | 50 | 40 | ABSENCE | 50 | W | E | E | COMPARATIVE EXAMPLE |
| 31 | 15 | 57 | 40 | ABSENCE | 51 | M | E | E | INVENTION EXAMPLE |

TABLE 3-continued

| | | | | | | | | | |
|---|---|---|---|---|---|---|---|---|---|
| 32 | 15 | 60 | 40 | ABSENCE | 54 | M | E | E | INVENTION EXAMPLE |
| 33 | 15 | 63 | 40 | ABSENCE | 53 | W | E | E | COMPARATIVE EXAMPLE |
| 34 | 15 | 70 | 40 | ABSENCE | 54 | W | E | E | COMPARATIVE EXAMPLE |
| 35 | — | 0 | 40 | ABSENCE | UNMEASURABLE | W | E | W | COMPARATIVE EXAMPLE |
| 36 | 15 | 3 | 40 | ABSENCE | 32 | E | E | E | INVENTION EXAMPLE |
| 37 | 15 | 3 | 40 | ABSENCE | 42 | E | E | E | INVENTION EXAMPLE |
| 38 | 3 | 0 | 40 | ABSENCE | 38 | E | E | E | INVENTION EXAMPLE |
| 39 | 3 | 0 | 40 | ABSENCE | 37 | M | E | E | INVENTION EXAMPLE |
| 40 | 3 | 0 | 40 | ABSENCE | 41 | W | E | E | COMPARATIVE EXAMPLE |
| 41 | 3 | 0 | 40 | ABSENCE | 38 | W | E | E | COMPARATIVE EXAMPLE |
| 42 | 3 | 45 | 40 | ABSENCE | 45 | E | E | E | INVENTION EXAMPLE |
| 43 | 10 | 45 | 40 | ABSENCE | 49 | E | E | E | INVENTION EXAMPLE |
| 44 | 15 | 45 | 40 | ABSENCE | 51 | M | E | E | INVENTION EXAMPLE |
| 45 | 17 | 45 | 40 | ABSENCE | 52 | W | E | E | COMPARATIVE EXAMPLE |
| 46 | 20 | 45 | 40 | ABSENCE | 52 | W | E | E | COMPARATIVE EXAMPLE |
| 47 | 30 | 45 | 40 | ABSENCE | 58 | W | E | E | COMPARATIVE EXAMPLE |
| 48 | 15 | 0 | 40 | ABSENCE | 42 | E | E | E | INVENTION EXAMPLE |
| 49 | 15 | 15 | 40 | ABSENCE | 44 | E | E | E | INVENTION EXAMPLE |
| 50 | 15 | 45 | 40 | ABSENCE | 52 | M | E | E | INTENTION EXAMPLE |
| 51 | 15 | 57 | 40 | ABSENCE | 53 | M | E | E | INVENTION EXAMPLE |
| 52 | 15 | 60 | 40 | ABSENCE | 53 | M | E | E | INVENTION EXAMPLE |
| 53 | 15 | 63 | 40 | ABSENCE | 55 | W | E | E | COMPARATIVE EXAMPLE |
| 54 | 15 | 70 | 40 | ABSENCE | 54 | W | E | E | COMPARATIVE EXAMPLE |
| 55 | 15 | 120 | 40 | ABSENCE | 67 | W | E | E | COMPARATIYE EXAMPLE |

TABLE 4

| | | ANNEALING | PICKLING | | | WATER WASHING | | | |
|---|---|---|---|---|---|---|---|---|---|
| TEST No. | STEEL TYPE | DEW POINT (° C.) | PICKLNG SOLUTION | TEMPERATURE (° C.) | IMMERSION TIME (SECOND) | PRESENCE/ ABSENCE | CONDUCTIVITY (mS/m) | FORMULA 1 | WATER VOLUME DENSITY (L/s · m$^2$) |
| 56 | A | −40 | NITRIC ACID | 79 | 6 | ABSENCE | — | — | — |
| 57 | A | −40 | NITRIC ACID | 77 | 10 | PRESENCE | 0.22 | E | 23 |
| 58 | A | −52 | NITRIC ACID | 53 | 12 | PRESENCE | 2.9 | E | 23 |
| 59 | A | −42 | NITRIC ACID | 78 | 9 | PRESENCE | 4.5 | E | 23 |
| 60 | A | −55 | NITRIC ACID | 46 | 12 | PRESENCE | 5.0 | E | 23 |
| 61 | A | −46 | NITRIC ACID | 68 | 11 | PRESENCE | 5.2 | W | 23 |
| 62 | A | −54 | NITRIC ACID | 53 | 16 | PRESENCE | 5.5 | W | 23 |
| 63 | A | −51 | NITRIC ACID | 62 | 10 | PRESENCE | 2.9 | E | 23 |
| 64 | A | −54 | NITRIC ACID | 66 | 15 | PRESENCE | 2.9 | E | 23 |
| 65 | A | −53 | NITRIC ACID | 55 | 12 | PRESENCE | 2.9 | E | 23 |
| 66 | A | −46 | NITRIC ACID | 71 | 12 | PRESENCE | 2.9 | E | 23 |
| 67 | A | −54 | NITRIC ACID | 63 | 15 | PRESENCE | 2.9 | E | 23 |
| 68 | A | −55 | NITRIC ACID | 57 | 8 | PRESENCE | 2.9 | E | 23 |
| 69 | A | −46 | NITRIC ACID | 86 | 5 | PRESENCE | 2.9 | E | 23 |
| 70 | A | −50 | NITRIC ACID | 78 | 12 | PRESENCE | 2.9 | E | 23 |
| 71 | A | −51 | NITRIC ACID | 44 | 14 | PRESENCE | 2.9 | E | 23 |
| 72 | A | −47 | NITRIC ACID | 84 | 16 | PRESENCE | 2.9 | E | 23 |
| 73 | A | −46 | NITRIC ACID | 70 | 19 | PRESENCE | 2.9 | E | 23 |
| 74 | A | −54 | NITRIC ACID | 40 | 14 | PRESENCE | 2.9 | E | 23 |
| 75 | A | −47 | NITRIC ACID | 48 | 10 | PRESENCE | 2.9 | E | 23 |
| 76 | A | −54 | NITRIC ACID | 58 | 13 | PRESENCE | 2.9 | E | 23 |
| 77 | A | −40 | HYDROCHLORIC ACID + SULFURIC ACID | 40 | 12 | ABSENCE | — | — | — |
| 78 | A | −40 | HYDROCHLORIC ACID + SULFURIC ACID | 70 | 11 | PRESENCE | 0.22 | E | 23 |
| 79 | A | −46 | HYDROCHLORIC ACID + SULFURIC ACID | 78 | 13 | PRESENCE | 2.9 | E | 23 |
| 80 | A | −41 | HYDROCHLORIC ACID + SULFURIC ACID | 57 | 16 | PRESENCE | 4.5 | E | 23 |
| 81 | A | −45 | HYDROCHLORIC ACID + SULFURIC ACID | 62 | 9 | PRESENCE | 5.0 | E | 23 |
| 82 | A | −52 | HYDROCHLORIC ACID + SULFURIC ACID | 83 | 6 | PRESENCE | 5.2 | W | 23 |
| 83 | A | −47 | HYDROCHLORIC ACID + SULFURIC ACID | 55 | 14 | PRESENCE | 5.5 | W | 23 |
| 84 | A | −40 | HYDROCHLORIC ACID + SULFURIC ACID | 46 | 12 | PRESENCE | 2.9 | E | 23 |
| 85 | A | −46 | HYDROCHLORIC ACID + SULFURIC ACID | 57 | 9 | PRESENCE | 2.9 | E | 23 |
| 86 | A | −52 | HYDROCHLORIC ACID + SULFURIC ACID | 83 | 15 | PRESENCE | 2.9 | E | 23 |
| 87 | A | −49 | HYDROCHLORIC ACID + SULFURIC ACID | 57 | 11 | PRESENCE | 2.9 | E | 23 |
| 88 | A | −42 | HYDROCHLORIC ACID + SULFURIC ACID | 66 | 14 | PRESENCE | 2.9 | E | 23 |
| 89 | A | −51 | HYDROCHLORIC ACID + SULFURIC ACID | 64 | 14 | PRESENCE | 2.9 | E | 23 |
| 90 | A | −41 | HYDROCHLORIC ACID + SULFURIC ACID | 55 | 15 | PRESENCE | 2.9 | E | 23 |
| 91 | A | −53 | HYDROCHLORIC ACID + SULFURIC ACID | 66 | 16 | PRESENCE | 2.9 | E | 23 |
| 92 | A | −45 | HYDROCHLORIC ACID + SULFURIC ACID | 76 | 8 | PRESENCE | 2.9 | E | 23 |
| 93 | A | −40 | HYDROCHLORIC ACID + SULFURIC ACID | 71 | 8 | PRESENCE | 2.9 | E | 23 |
| 94 | A | −49 | HYDROCHLORIC ACID + SULFURIC ACID | 63 | 14 | PRESENCE | 2.9 | E | 23 |
| 95 | A | −44 | HYDROCHLORIC ACID + SULFURIC ACID | 65 | 10 | PRESENCE | 2.9 | E | 23 |
| 96 | A | −40 | HYDROCHLORIC ACID + SULFURIC ACID | 74 | 16 | PRESENCE | 2.9 | E | 23 |
| 97 | A | −45 | HYDROCHLORIC ACID + SULFURIC ACID | 54 | 11 | PRESENCE | 2.9 | E | 23 |

TABLE 4-continued

| | WATER WASHING | | DRYING | | | | EVALUATION | | | |
|---|---|---|---|---|---|---|---|---|---|---|
| TEST No. | WATER TEMPERATURE (° C.) | WATER-WASHING TIME (SECOND) | TIME TO DRYING START (SECOND) | DRYING TEMPERATURE (° C.) | Ni PLATING | THICKNESS OF OXIDE FILM (μm) | CONVERSION TREATABILITY | THICKNESS OF DECARBURIZED LAYER | DEGREASING ABILITY | REMARK |
| 56 | — | — | 5 | 40 | ABSENCE | UNMEASURABLE | W | E | W | COMPARATIVE EXAMPLE |
| 57 | 18 | 15 | 3 | 40 | ABSENCE | 32 | E | E | E | INVENTION EXAMPLE |
| 58 | 18 | 15 | 3 | 40 | ABSENCE | 40 | E | E | E | INVENTION EXAMPLE |
| 59 | 18 | 3 | 0 | 40 | ABSENCE | 37 | E | E | E | INVENTION EXAMPLE |
| 60 | 18 | 3 | 0 | 40 | ABSENCE | 39 | M | E | E | INVENTION EXAMPLE |
| 61 | 18 | 3 | 0 | 40 | ABSENCE | 42 | W | E | E | COMPARATIVE EXAMPLE |
| 62 | 18 | 3 | 0 | 40 | ABSENCE | 44 | W | E | E | COMPARATIVE EXAMPLE |
| 63 | 18 | 3 | 45 | 40 | ABSENCE | 46 | E | E | E | INVENTION EXAMPLE |
| 64 | 18 | 10 | 45 | 40 | ABSENCE | 48 | E | E | E | INVENTION EXAMPLE |
| 65 | 18 | 15 | 45 | 40 | ABSENCE | 49 | M | E | E | INVENTION EXAMPLE |
| 66 | 18 | 17 | 45 | 40 | ABSENCE | 52 | W | E | E | COMPARATIVE EXAMPLE |
| 67 | 18 | 20 | 45 | 40 | ABSENCE | 55 | W | E | E | COMPARATIVE EXAMPLE |
| 68 | 18 | 30 | 45 | 40 | ABSENCE | 59 | W | E | E | COMPARATIVE EXAMPLE |
| 69 | 18 | 15 | 0 | 40 | ABSENCE | 41 | E | E | E | INVENTION EXAMPLE |
| 70 | 18 | 15 | 15 | 40 | ABSENCE | 46 | E | E | E | INVENTION EXAMPLE |
| 71 | 18 | 15 | 45 | 40 | ABSENCE | 50 | M | E | E | INVENTION EXAMPLE |
| 72 | 18 | 15 | 57 | 40 | ABSENCE | 54 | M | E | E | INVENTION EXAMPLE |
| 73 | 18 | 15 | 60 | 40 | ABSENCE | 51 | M | E | E | INVENTION EXAMPLE |
| 74 | 18 | 15 | 63 | 40 | ABSENCE | 55 | W | E | E | COMPARATIVE EXAMPLE |
| 75 | 18 | 15 | 70 | 40 | ABSENCE | 55 | W | E | E | COMPARATIVE EXAMPLE |
| 76 | 18 | 15 | 120 | 40 | ABSENCE | 66 | W | E | E | COMPARATIVE EXAMPLE |
| 77 | — | — | 5 | 40 | ABSENCE | UNMEASURABLE | W | E | W | COMPARATIVE EXAMPLE |
| 78 | 18 | 15 | 3 | 40 | ABSENCE | 32 | E | E | E | INVENTION EXAMPLE |
| 79 | 18 | 15 | 3 | 40 | ABSENCE | 44 | E | E | E | INVENTION EXAMPLE |
| 80 | 18 | 3 | 0 | 40 | ABSENCE | 37 | E | E | E | INVENTION EXAMPLE |
| 81 | 18 | 3 | 0 | 40 | ABSENCE | 38 | M | E | E | INVENTION EXAMPLE |
| 82 | 18 | 3 | 0 | 40 | ABSENCE | 40 | W | E | E | COMPARATIVE EXAMPLE |
| 83 | 18 | 3 | 0 | 40 | ABSENCE | 42 | W | E | E | COMPARATIVE EXAMPLE |
| 84 | 18 | 3 | 45 | 40 | ABSENCE | 47 | E | E | E | INVENTION EXAMPLE |
| 85 | 18 | 10 | 45 | 40 | ABSENCE | 50 | E | E | E | INVENTION EXAMPLE |
| 86 | 18 | 15 | 45 | 40 | ABSENCE | 49 | M | E | E | INVENTION EXAMPLE |
| 87 | 18 | 17 | 45 | 40 | ABSENCE | 52 | W | E | E | COMPARATIVE EXAMPLE |
| 88 | 18 | 20 | 45 | 40 | ABSENCE | 54 | W | E | E | COMPARATIVE EXAMPLE |
| 89 | 18 | 30 | 45 | 40 | ABSENCE | 59 | W | E | E | COMPARATIVE EXAMPLE |
| 90 | 18 | 15 | 0 | 40 | ABSENCE | 43 | E | E | E | INVENTION EXAMPLE |
| 91 | 18 | 15 | 15 | 40 | ABSENCE | 44 | E | E | E | INVENTION EXAMPLE |
| 92 | 18 | 15 | 45 | 40 | ABSENCE | 52 | M | E | E | INVENTION EXAMPLE |
| 93 | 18 | 15 | 57 | 40 | ABSENCE | 52 | M | E | E | INVENTION EXAMPLE |
| 94 | 18 | 15 | 60 | 40 | ABSENCE | 54 | M | E | E | INVENTION EXAMPLE |
| 95 | 18 | 15 | 63 | 40 | ABSENCE | 54 | W | E | E | COMPARATIVE EXAMPLE |
| 96 | 18 | 15 | 70 | 40 | ABSENCE | 56 | W | E | E | COMPARATIVE EXAMPLE |
| 97 | 18 | 15 | 120 | 40 | ABSENCE | 67 | W | E | E | COMPARATIVE EXAMPLE |

TABLE 5

| | | ANNEALING | PICKLING | | | WATER WASHING | | | | |
|---|---|---|---|---|---|---|---|---|---|---|
| | | | | | | | | WATER | | |
| TEST No. | STEEL TYPE | DEW POINT (° C.) | PICKLING SOLUTION | TEMPERATURE (° C.) | IMMERSION TIME (SECOND) | PRESENCE/ ABSENCE | CONDUCTIVITY (mS/m) | FORMULA 1 | VOLUME DENSITY (L/s · m$^2$) | WATER TEMPERATURE (° C.) |
| 98 | A | −40 | HYDROCHLORIC ACID + NITRIC ACID | 60 | 9 | ABSENCE | — | — | — | — |
| 99 | A | −40 | HYDROCHLORIC ACID + NITRIC ACID | 52 | 15 | PRESENCE | 0.22 | E | 23 | 18 |
| 100 | A | −51 | HYDROCHLORIC ACID + NITRIC ACID | 51 | 16 | PRESENCE | 2.9 | E | 23 | 18 |
| 101 | A | −43 | HYDROCHLORIC ACID + NITRIC ACID | 54 | 17 | PRESENCE | 4.5 | E | 23 | 18 |
| 102 | A | −44 | HYDROCHLORIC ACID + NITRIC ACID | 49 | 10 | PRESENCE | 5.0 | E | 23 | 18 |
| 103 | A | −53 | HYDROCHLORIC ACID + NITRIC ACID | 60 | 12 | PRESENCE | 5.2 | W | 23 | 18 |
| 104 | A | −41 | HYDROCHLORIC ACID + NITRIC ACID | 45 | 10 | PRESENCE | 5.5 | W | 23 | 18 |
| 105 | A | −53 | HYDROCHLORIC ACID + NITRIC ACID | 68 | 12 | PRESENCE | 2.9 | E | 23 | 18 |
| 106 | A | −44 | HYDROCHLORIC ACID + NITRIC ACID | 88 | 19 | PRESENCE | 2.9 | E | 23 | 18 |
| 107 | A | −48 | HYDROCHLORIC ACID + NITRIC ACID | 42 | 14 | PRESENCE | 2.9 | E | 23 | 18 |
| 108 | A | −55 | HYDROCHLORIC ACID + NITRIC ACID | 72 | 14 | PRESENCE | 2.9 | E | 23 | 18 |
| 109 | A | −55 | HYDROCHLORIC ACID + NITRIC ACID | 51 | 13 | PRESENCE | 2.9 | E | 23 | 18 |
| 110 | A | −40 | HYDROCHLORIC ACID + NITRIC ACID | 55 | 18 | PRESENCE | 2.9 | E | 23 | 18 |
| 111 | A | −55 | HYDROCHLORIC ACID + NITRIC ACID | 33 | 18 | PRESENCE | 2.9 | E | 23 | 18 |
| 112 | A | −50 | HYDROCHLORIC ACID + NITRIC ACID | 54 | 11 | PRESENCE | 2.9 | E | 23 | 18 |
| 113 | A | −45 | HYDROCHLORIC ACID + NITRIC ACID | 37 | 14 | PRESENCE | 2.9 | E | 23 | 18 |
| 114 | A | −53 | HYDROCHLORIC ACID + NITRIC ACID | 53 | 8 | PRESENCE | 2.9 | E | 23 | 18 |
| 115 | A | −50 | HYDROCHLORIC ACID + NITRIC ACID | 61 | 13 | PRESENCE | 2.9 | E | 23 | 18 |
| 116 | A | −44 | HYDROCHLORIC ACID + NITRIC ACID | 52 | 13 | PRESENCE | 2.9 | E | 23 | 18 |
| 117 | A | −52 | HYDROCHLORIC ACID + NITRIC ACID | 51 | 16 | PRESENCE | 2.9 | E | 23 | 18 |
| 118 | A | −49 | HYDROCHLORIC ACID + NITRIC ACID | 62 | 11 | PRESENCE | 2.9 | E | 23 | 18 |
| 119 | A | −40 | NITRIC ACID + SULFURIC ACID | 35 | 7 | ABSENCE | — | — | — | — |
| 120 | A | −40 | NITRIC ACID + SULFURIC ACID | 62 | 12 | PRESENCE | 0.22 | E | 23 | 18 |
| 121 | A | −48 | NITRIC ACID + SULFURIC ACID | 46 | 5 | PRESENCE | 2.9 | E | 23 | 18 |
| 122 | A | −46 | NITRIC ACID + SULFURIC ACID | 81 | 7 | PRESENCE | 4.5 | E | 23 | 18 |
| 123 | A | −50 | NITRIC ACID + SULFURIC ACID | 67 | 15 | PRESENCE | 5.0 | E | 23 | 18 |
| 124 | A | −40 | NITRIC ACID + SULFURIC ACID | 77 | 11 | PRESENCE | 5.2 | W | 23 | 18 |
| 125 | A | −44 | NITRIC ACID + SULFURIC ACID | 70 | 13 | PRESENCE | 5.5 | W | 23 | 18 |
| 126 | A | −49 | NITRIC ACID + SULFURIC ACID | 52 | 13 | PRESENCE | 2.9 | E | 23 | 18 |
| 127 | A | −47 | NITRIC ACID + SULFURIC ACID | 56 | 11 | PRESENCE | 2.9 | E | 23 | 18 |
| 128 | A | −51 | NITRIC ACID + SULFURIC ACID | 48 | 11 | PRESENCE | 2.9 | E | 23 | 18 |
| 129 | A | −46 | NITRIC ACID + SULFURIC ACID | 60 | 8 | PRESENCE | 2.9 | E | 23 | 18 |
| 130 | A | −41 | NITRIC ACID + SULFURIC ACID | 66 | 14 | PRESENCE | 2.9 | E | 23 | 18 |
| 131 | A | −48 | NITRIC ACID + SULFURIC ACID | 50 | 11 | PRESENCE | 2.9 | E | 23 | 18 |
| 132 | A | −43 | NITRIC ACID + SULFURIC ACID | 40 | 10 | PRESENCE | 2.9 | E | 23 | 18 |
| 133 | A | −49 | NITRIC ACID + SULFURIC ACID | 63 | 6 | PRESENCE | 2.9 | E | 23 | 18 |
| 134 | A | −44 | NITRIC ACID + SULFURIC ACID | 40 | 9 | PRESENCE | 2.9 | E | 23 | 18 |
| 135 | A | −49 | NITRIC ACID + SULFURIC ACID | 57 | 6 | PRESENCE | 2.9 | E | 23 | 18 |
| 136 | A | −45 | NITRIC ACID + SULFURIC ACID | 57 | 10 | PRESENCE | 2.9 | E | 23 | 18 |
| 137 | A | −44 | NITRIC ACID + SULFURIC ACID | 58 | 16 | PRESENCE | 2.9 | E | 23 | 18 |
| 138 | A | −48 | NITRIC ACID + SULFURIC ACID | 80 | 15 | PRESENCE | 2.9 | E | 23 | 18 |
| 139 | A | −50 | NITRIC ACID + SULFURIC ACID | 72 | 13 | PRESENCE | 2.9 | E | 23 | 18 |

TABLE 5-continued

| TEST No. | WATER WASHING: WATER-WASHING TIME (SECOND) | DRYING: TIME TO DRYING START (SECOND) | DRYING: DRYING TEMPERATURE (° C.) | Ni PLATING | THICKNESS OF OXIDE FILM (μm) | EVALUATION: CONVERSION TREATABILITY | EVALUATION: THICKNESS OF DECARBURIZED LAYER | EVALUATION: DECREASING ABILITY | REMARK |
|---|---|---|---|---|---|---|---|---|---|
| 98 | — | 5 | 40 | ABSENCE | UNMEASURABLE | W | E | W | COMPARATIVE EXAMPLE |
| 99 | 15 | 3 | 40 | ABSENCE | 30 | E | E | E | INVENTION EXAMPLE |
| 100 | 15 | 3 | 40 | ABSENCE | 40 | E | E | E | INTENTION EXAMPLE |
| 101 | 3 | 0 | 40 | ABSENCE | 40 | E | E | E | INTENTION EXAMPLE |
| 102 | 3 | 0 | 40 | ABSENCE | 36 | M | E | E | INTENTION EXAMPLE |
| 103 | 3 | 0 | 40 | ABSENCE | 43 | W | E | E | COMPARATIVE EXAMPLE |
| 104 | 3 | 0 | 40 | ABSENCE | 42 | W | E | E | COMPARATIVE EXAMPLE |
| 105 | 3 | 45 | 40 | ABSENCE | 45 | E | E | E | INVENTION EXAMPLE |
| 106 | 10 | 45 | 40 | ABSENCE | 46 | E | E | E | INVENTION EXAMPLE |
| 107 | 15 | 45 | 40 | ABSENCE | 51 | M | E | E | INVENTION EXAMPLE |
| 108 | 17 | 45 | 40 | ABSENCE | 50 | W | E | E | COMPARATIVE EXAMPLE |
| 109 | 20 | 45 | 40 | ABSENCE | 52 | W | E | E | COMPARATIVE EXAMPLE |
| 110 | 30 | 45 | 40 | ABSENCE | 59 | W | E | E | COMPARATIVE EXAMPLE |
| 111 | 15 | 0 | 40 | ABSENCE | 42 | E | E | E | INTENTION EXAMPLE |
| 112 | 15 | 15 | 40 | ABSENCE | 44 | E | E | E | INTENTION EXAMPLE |
| 113 | 15 | 45 | 40 | ABSENCE | 52 | M | E | E | INTENTION EXAMPLE |
| 114 | 15 | 57 | 40 | ABSENCE | 53 | M | E | E | INTENTION EXAMPLE |
| 115 | 15 | 60 | 40 | ABSENCE | 55 | M | E | E | INTENTION EXAMPLE |
| 116 | 15 | 63 | 40 | ABSENCE | 53 | W | E | E | COMPARATIVE EXAMPLE |
| 117 | 15 | 70 | 40 | ABSENCE | 55 | W | E | E | COMPARATIVE EXAMPLE |
| 118 | 15 | 120 | 40 | ABSENCE | 66 | W | E | E | COMPARATIVE EXAMPLE |
| 119 | — | 5 | 40 | ABSENCE | UNMEASURABLE | W | E | W | COMPARATIVE EXAMPLE |
| 120 | 15 | 3 | 40 | ABSENCE | 30 | E | E | E | INVENTION EXAMPLE |
| 121 | 15 | 3 | 40 | ABSENCE | 43 | E | E | E | INVENTION EXAMPLE |
| 122 | 3 | 0 | 40 | ABSENCE | 37 | E | E | E | INVENTION EXAMPLE |
| 123 | 3 | 0 | 40 | ABSENCE | 38 | M | E | E | INVENTION EXAMPLE |
| 124 | 3 | 0 | 40 | ABSENCE | 47 | W | E | E | COMPARATIVE EXAMPLE |
| 125 | 3 | 0 | 40 | ABSENCE | 44 | W | E | E | COMPARATIVE EXAMPLE |
| 126 | 3 | 45 | 40 | ABSENCE | 46 | E | E | E | INTENTION EXAMPLE |
| 127 | 10 | 45 | 40 | ABSENCE | 49 | E | E | E | INTENTION EXAMPLE |
| 128 | 15 | 45 | 40 | ABSENCE | 51 | M | E | E | INTENTION EXAMPLE |
| 129 | 17 | 45 | 40 | ABSENCE | 51 | W | E | E | COMPARATIVE EXAMPLE |
| 130 | 20 | 45 | 40 | ABSENCE | 53 | W | E | E | COMPARATIVE EXAMPLE |
| 131 | 30 | 45 | 40 | ABSENCE | 59 | W | E | E | COMPARATIVE EXAMPLE |
| 132 | 15 | 0 | 40 | ABSENCE | 40 | E | E | E | INVENTION EXAMPLE |
| 133 | 15 | 15 | 40 | ABSENCE | 45 | E | E | E | INVENTION EXAMPLE |
| 134 | 15 | 45 | 40 | ABSENCE | 51 | M | E | E | INVENTION EXAMPLE |
| 135 | 15 | 57 | 40 | ABSENCE | 55 | M | E | E | INVENTION EXAMPLE |
| 136 | 15 | 60 | 40 | ABSENCE | 55 | M | E | E | INVENTION EXAMPLE |
| 137 | 15 | 63 | 40 | ABSENCE | 55 | W | E | E | COMPARATIVE EXAMPLE |
| 138 | 15 | 70 | 40 | ABSENCE | 55 | W | E | E | COMPARATIVE EXAMPLE |
| 139 | 15 | 120 | 40 | ABSENCE | 65 | W | E | E | COMPARATIVE EXAMPLE |

TABLE 6

| | | ANNEALING | PICKLING | | | WATER WASHING | | | | |
|---|---|---|---|---|---|---|---|---|---|---|
| | | | | | | | | WATER | | |
| TEST No. | STEEL TYPE | DEW POINT (° C.) | PICKLING SOLUTION | TEMPERATURE (° C.) | IMMERSION TIME (SECOND) | PRESENCE/ ABSENCE | CONDUCTIVITY (mS/m) | FORMULA 1 | VOLUME DENSITY (L/s · m$^2$) | WATER TEMPERATURE (° C.) |
| 140 | B | −40 | ABSENCE | ABSENCE | ABSENCE | ABSENCE | — | — | — | — |
| 141 | B | −40 | HYDROCHLORIC ACID | 78 | 19 | PRESENCE | 2.9 | E | 23 | 18 |
| 142 | B | −35 | HYDROCHLORIC ACID | 63 | 20 | PRESENCE | 2.9 | E | 23 | 18 |
| 143 | B | −33 | HYDROCHLORIC ACID | 68 | 16 | PRESENCE | 2.9 | E | 23 | 18 |
| 144 | B | −55 | HYDROCHLORIC ACID | 74 | 15 | PRESENCE | 0.22 | E | 23 | 18 |
| 145 | B | −41 | HYDROCHLORIC ACID | 87 | 15 | PRESENCE | 2.9 | E | 23 | 18 |
| 146 | B | −50 | HYDROCHLORIC ACID | 73 | 17 | PRESENCE | 4.5 | E | 23 | 18 |
| 147 | B | −49 | HYDROCHLORIC ACID | 56 | 11 | PRESENCE | 5.0 | E | 23 | 18 |
| 148 | B | −47 | HYDROCHLORIC ACID | 71 | 17 | PRESENCE | 5.2 | W | 23 | 18 |
| 149 | B | −45 | HYDROCHLORIC ACID | 68 | 15 | PRESENCE | 5.5 | W | 23 | 18 |
| 150 | B | −51 | HYDROCHLORIC ACID | 61 | 13 | PRESENCE | 2.9 | E | 23 | 18 |
| 151 | B | −47 | HYDROCHLORIC ACID | 71 | 14 | PRESENCE | 2.9 | E | 23 | 18 |
| 152 | B | −55 | HYDROCHLORIC ACID | 77 | 22 | PRESENCE | 2.9 | E | 23 | 18 |
| 153 | B | −53 | HYDROCHLORIC ACID | 69 | 19 | PRESENCE | 2.9 | E | 23 | 18 |
| 154 | B | −49 | HYDROCHLORIC ACID | 73 | 21 | PRESENCE | 2.9 | E | 23 | 18 |
| 155 | B | −47 | HYDROCHLORIC ACID | 73 | 13 | PRESENCE | 2.9 | E | 23 | 18 |
| 156 | B | −54 | HYDROCHLORIC ACID | 81 | 18 | PRESENCE | 2.9 | E | 23 | 18 |
| 157 | B | −51 | HYDROCHLORIC ACID | 62 | 13 | PRESENCE | 2.9 | E | 23 | 18 |
| 158 | B | −54 | HYDROCHLORIC ACID | 66 | 16 | PRESENCE | 2.9 | E | 23 | 18 |
| 159 | B | −48 | HYDROCHLORIC ACID | 67 | 15 | PRESENCE | 2.9 | E | 23 | 18 |
| 160 | B | −51 | HYDROCHLORIC ACID | 71 | 16 | PRESENCE | 2.9 | E | 23 | 18 |
| 161 | B | −51 | HYDROCHLORIC ACID | 70 | 14 | PRESENCE | 2.9 | E | 23 | 18 |
| 162 | B | −44 | HYDROCHLORIC ACID | 64 | 13 | PRESENCE | 2.9 | E | 23 | 18 |
| 163 | B | −42 | HYDROCHLORIC ACID | 55 | 18 | PRESENCE | 2.9 | E | 23 | 18 |
| 164 | B | −40 | SULFURIC ACID | 70 | 15 | ABSENCE | — | — | — | — |
| 165 | B | −40 | SULFURIC ACID | 75 | 15 | PRESENCE | 2.9 | E | 23 | 18 |
| 166 | B | −35 | SULFURIC ACID | 81 | 14 | PRESENCE | 2.9 | E | 23 | 18 |
| 167 | B | −33 | SULFURIC ACID | 65 | 14 | PRESENCE | 2.9 | E | 23 | 18 |
| 168 | B | −44 | SULFURIC ACID | 75 | 14 | PRESENCE | 0.22 | E | 23 | 18 |
| 169 | B | −51 | SULFURIC ACID | 64 | 12 | PRESENCE | 2.9 | E | 23 | 18 |
| 170 | B | −47 | SULFURIC ACID | 62 | 12 | PRESENCE | 4.5 | E | 23 | 18 |
| 171 | B | −46 | SULFURIC ACID | 69 | 9 | PRESENCE | 5.0 | E | 23 | 18 |
| 172 | B | −50 | SULFURIC ACID | 61 | 17 | PRESENCE | 5.2 | W | 23 | 18 |
| 173 | B | −53 | SULFURIC ACID | 69 | 21 | PRESENCE | 5.5 | W | 23 | 18 |
| 174 | B | −40 | SULFURIC ACID | 74 | 18 | PRESENCE | 4.5 | E | 23 | 18 |
| 175 | B | −41 | SULFURIC ACID | 71 | 18 | PRESENCE | 4.5 | E | 23 | 18 |
| 176 | B | −43 | SULFURIC ACID | 66 | 18 | PRESENCE | 4.5 | E | 23 | 18 |
| 177 | B | −53 | SULFURIC ACID | 70 | 11 | PRESENCE | 4.5 | E | 23 | 18 |
| 178 | B | −54 | SULFURIC ACID | 75 | 16 | PRESENCE | 4.5 | E | 23 | 18 |
| 179 | B | −44 | SULFURIC ACID | 73 | 17 | PRESENCE | 4.5 | E | 23 | 18 |
| 180 | B | −51 | SULFURIC ACID | 61 | 9 | PRESENCE | 4.5 | E | 23 | 18 |
| 181 | B | −45 | SULFURIC ACID | 68 | 13 | PRESENCE | 4.5 | E | 23 | 18 |
| 182 | B | −47 | SULFURIC ACID | 75 | 16 | PRESENCE | 4.5 | E | 23 | 18 |

TABLE 6-continued

| | | | | | | | | | | |
|---|---|---|---|---|---|---|---|---|---|---|
| 183 | B | −53 | SULFURIC ACID | 68 | 13 | PRESENCE | 4.5 | E | 23 | 18 |
| 184 | B | −46 | SULFURIC ACID | 74 | 17 | PRESENCE | 4.5 | E | 23 | 18 |
| 185 | B | −49 | SULFURIC ACID | 65 | 24 | PRESENCE | 4.5 | E | 23 | 18 |
| 186 | B | −50 | SULFURIC ACID | 70 | 15 | PRESENCE | 4.5 | E | 23 | 18 |
| 187 | B | −52 | SULFURIC ACID | 67 | 17 | PRESENCE | 4.5 | E | 23 | 18 |

| | WATER WASHING | DRYING | | | | EVALUATION | | | |
|---|---|---|---|---|---|---|---|---|---|
| TEST No. | WATER-WASHING TIME (SECOND) | TIME TO DRYING START (SECOND) | DRYING TEMPERATURE (° C.) | Ni PLATING | THICKNESS GF OXIDE FILM (μm) | CONVERSION TREATABILITY | THICKNESS OF DECARBURIZED LAYER | DECREASING ABILITY | REMARK |
| 140 | — | 5 | 40 | ABSENCE | UNMEASURABLE | W | E | E | COMPARATIVE EXAMPLE |
| 141 | 15 | 15 | 40 | ABSENCE | 44 | M | E | E | INVENTION EXAMPLE |
| 142 | 8 | 15 | 40 | ABSENCE | 40 | E | E | E | INVENTION EXAMPLE |
| 143 | 8 | 15 | 40 | ABSENCE | 41 | E | W | E | COMPARATIVE EXAMPLE |
| 144 | 8 | 30 | 40 | ABSENCE | 32 | E | E | E | INVENTION EXAMPLE |
| 145 | 8 | 30 | 40 | ABSENCE | 45 | E | E | E | INTENTION EXAMPLE |
| 146 | 8 | 30 | 40 | ABSENCE | 45 | M | E | E | INVENTION EXAMPLE |
| 147 | 8 | 30 | 40 | ABSENCE | 48 | M | E | E | INVENTION EXAMPLE |
| 148 | 8 | 30 | 40 | ABSENCE | 49 | W | E | E | COMPARATIVE EXAMPLE |
| 149 | 8 | 30 | 40 | ABSENCE | 45 | W | E | E | COMPARATIVE EXAMPLE |
| 150 | 3 | 30 | 40 | ABSENCE | 42 | E | E | E | INVENTION EXAMPLE |
| 151 | 10 | 30 | 40 | ABSENCE | 46 | M | E | E | INVENTION EXAMPLE |
| 152 | 15 | 30 | 40 | ABSENCE | 47 | M | E | E | INVENTION EXAMPLE |
| 153 | 17 | 30 | 40 | ABSENCE | 47 | W | E | E | COMPARATIVE EXAMPLE |
| 154 | 20 | 30 | 40 | ABSENCE | 49 | W | E | E | COMPARATIVE EXAMPLE |
| 155 | 30 | 30 | 40 | ABSENCE | 55 | W | E | E | COMPARATIVE EXAMPLE |
| 156 | 8 | 0 | 40 | ABSENCE | 37 | E | E | E | INVENTION EXAMPLE |
| 157 | 8 | 15 | 40 | ABSENCE | 42 | E | E | E | INVENTION EXAMPLE |
| 158 | 8 | 45 | 40 | ABSENCE | 48 | M | E | E | INVENTION EXAMPLE |
| 159 | 8 | 57 | 40 | ABSENCE | 50 | M | E | E | INVENTION EXAMPLE |
| 160 | 8 | 60 | 40 | ABSENCE | 50 | M | E | E | INVENTION EXAMPLE |
| 161 | 8 | 63 | 40 | ABSENCE | 53 | W | E | E | COMPARATIVE EXAMPLE |
| 162 | 8 | 70 | 40 | ABSENCE | 52 | W | E | E | COMPARATIVE EXAMPLE |
| 163 | 8 | 120 | 40 | ABSENCE | 63 | W | E | E | COMPARATIVE EXAMPLE |
| 164 | — | 5 | 40 | ABSENCE | UNMEASURABLE | W | E | W | COMPARATIVE EXAMPLE |
| 165 | 15 | 15 | 40 | ABSENCE | 47 | M | E | E | INVENTION EXAMPLE |
| 166 | 8 | 15 | 40 | ABSENCE | 42 | E | E | E | INVENTION EXAMPLE |
| 167 | 8 | 15 | 40 | ABSENCE | 40 | E | W | E | COMPARATIVE EXAMPLE |
| 168 | 8 | 30 | 40 | ABSENCE | 29 | E | E | E | INVENTION EXAMPLE |
| 169 | 8 | 30 | 40 | ABSENCE | 42 | E | E | E | INVENTION EXAMPLE |
| 170 | 8 | 30 | 40 | ABSENCE | 45 | M | E | E | INVENTION EXAMPLE |
| 171 | 8 | 30 | 40 | ABSENCE | 48 | M | E | E | INVENTION EXAMPLE |
| 172 | 8 | 30 | 40 | ABSENCE | 46 | W | E | E | COMPARATIVE EXAMPLE |
| 173 | 8 | 30 | 40 | ABSENCE | 45 | W | E | E | COMPARATIVE EXAMPLE |
| 174 | 8 | 30 | 40 | ABSENCE | 45 | M | E | E | INVENTION EXAMPLE |
| 175 | 10 | 30 | 40 | ABSENCE | 46 | M | E | E | INVENTION EXAMPLE |
| 176 | 15 | 30 | 40 | ABSENCE | 49 | M | E | E | INVENTION EXAMPLE |
| 177 | 17 | 30 | 40 | ABSENCE | 52 | W | E | E | COMPARATIVE EXAMPLE |

TABLE 6-continued

| | | | | | | | | | |
|---|---|---|---|---|---|---|---|---|---|
| 178 | 20 | 30 | 40 | ABSENCE | 51 | W | E | E | COMPARATIVE EXAMPLE |
| 179 | 30 | 30 | 40 | ABSENCE | 56 | W | E | E | COMPARATIVE EXAMPLE |
| 180 | 8 | 0 | 40 | ABSENCE | 40 | E | E | E | INVENTION EXAMPLE |
| 181 | 8 | 15 | 40 | ABSENCE | 45 | M | E | E | INVENTION EXAMPLE |
| 182 | 8 | 45 | 40 | ABSENCE | 52 | M | E | E | INVENTION EXAMPLE |
| 183 | 8 | 57 | 40 | ABSENCE | 50 | M | E | E | INVENTION EXAMPLE |
| 184 | 8 | 60 | 40 | ABSENCE | 53 | M | E | E | INVENTION EXAMPLE |
| 185 | 8 | 63 | 40 | ABSENCE | 53 | W | E | E | COMPARATIVE EXAMPLE |
| 186 | 8 | 70 | 40 | ABSENCE | 56 | W | E | E | COMPARATIVE EXAMPLE |
| 187 | 8 | 120 | 40 | ABSENCE | 63 | W | E | E | COMPARATIVE EXAMPLE |

TABLE 7

| | | ANNEALING | PICKLING | | | WATER WASHING | | | |
|---|---|---|---|---|---|---|---|---|---|
| TEST No. | STEEL TYPE | DEW POINT (° C.) | PICKLING SOLUTION | TEMPERATURE (° C.) | IMMERSION TIME (SECOND) | PRESENCE/ ABSENCE | CONDUCTIVITY (mS/m) | FORMULA 1 | WATER VOLUME DENSITY (L/s · m$^2$) |
| 188 | B | −40 | NITRIC ACID | 80 | 20 | ABSENCE | — | — | — |
| 189 | B | −40 | NITRIC ACID | 75 | 17 | PRESENCE | 2.9 | E | 23 |
| 190 | B | −35 | NITRIC ACID | 57 | 20 | PRESENCE | 2.9 | E | 23 |
| 191 | B | −33 | NITRIC ACID | 58 | 14 | PRESENCE | 2.9 | E | 23 |
| 192 | B | −53 | NITRIC ACID | 70 | 15 | PRESENCE | 0.22 | E | 23 |
| 193 | B | −47 | NITRIC ACID | 84 | 18 | PRESENCE | 2.9 | E | 23 |
| 194 | B | −47 | NITRIC ACID | 59 | 15 | PRESENCE | 4.5 | E | 23 |
| 195 | B | −51 | NITRIC ACID | 64 | 12 | PRESENCE | 5.0 | E | 23 |
| 196 | B | −55 | NITRIC ACID | 54 | 16 | PRESENCE | 5.2 | W | 23 |
| 197 | B | −49 | NITRIC ACID | 57 | 16 | PRESENCE | 5.5 | W | 23 |
| 198 | B | −51 | NITRIC ACID | 71 | 16 | PRESENCE | 2.9 | E | 23 |
| 199 | B | −54 | NITRIC ACID | 77 | 12 | PRESENCE | 2.9 | E | 23 |
| 200 | B | −46 | NITRIC ACID | 69 | 20 | PRESENCE | 2.9 | E | 23 |
| 201 | B | −46 | NITRIC ACID | 70 | 16 | PRESENCE | 2.9 | E | 23 |
| 202 | B | −50 | NITRIC ACID | 72 | 19 | PRESENCE | 2.9 | E | 23 |
| 203 | B | −43 | NITRIC ACID | 62 | 17 | PRESENCE | 2.9 | E | 23 |
| 204 | B | −41 | NITRIC ACID | 72 | 17 | PRESENCE | 2.9 | E | 23 |
| 205 | B | −42 | NITRIC ACID | 74 | 15 | PRESENCE | 2.9 | E | 23 |
| 206 | B | −49 | NITRIC ACID | 86 | 18 | PRESENCE | 2.9 | E | 23 |
| 207 | B | −51 | NITRIC ACID | 71 | 17 | PRESENCE | 2.9 | E | 23 |
| 208 | B | −43 | NITRIC ACID | 73 | 16 | PRESENCE | 2.9 | E | 23 |
| 209 | B | −42 | NITRIC ACID | 77 | 22 | PRESENCE | 2.9 | E | 23 |
| 210 | B | −50 | NITRIC ACID | 77 | 18 | PRESENCE | 2.9 | E | 23 |
| 211 | B | −47 | NITRIC ACID | 71 | 11 | PRESENCE | 2.9 | E | 23 |
| 212 | B | −40 | HYDROCHLORIC ACID + SULFURIC ACID | 78 | 18 | ABSENCE | — | — | — |
| 213 | B | −40 | HYDROCHLORIC ACID + SULFURIC ACID | 58 | 12 | PRESENCE | 2.9 | E | 23 |
| 214 | B | −35 | HYDROCHLORIC ACID + SULFURIC ACID | 68 | 21 | PRESENCE | 2.9 | E | 23 |
| 215 | B | −33 | HYDROCHLORIC ACID + SULFURIC ACID | 65 | 14 | PRESENCE | 2.9 | E | 23 |
| 216 | B | −43 | HYDROCHLORIC ACID + SULFURIC ACID | 66 | 19 | PRESENCE | 0.22 | E | 23 |
| 217 | B | −44 | HYDROCHLORIC ACID + SULFURIC ACID | 85 | 17 | PRESENCE | 2.9 | E | 23 |
| 218 | B | −45 | HYDROCHLORIC ACID + SULFURIC ACID | 74 | 19 | PRESENCE | 4.5 | E | 23 |
| 219 | B | −41 | HYDROCHLORIC ACID + SULFURIC ACID | 61 | 14 | PRESENCE | 5.0 | E | 23 |
| 220 | B | −51 | HYDROCHLORIC ACID + SULFURIC ACID | 66 | 22 | PRESENCE | 5.2 | W | 23 |
| 221 | B | −40 | HYDROCHLORIC ACID + SULFURIC ACID | 71 | 17 | PRESENCE | 5.5 | W | 23 |
| 222 | B | −51 | HYDROCHLORIC ACID + SULFURIC ACID | 75 | 15 | PRESENCE | 4.5 | E | 23 |
| 223 | B | −52 | HYDROCHLORIC ACID + SULFURIC ACID | 67 | 16 | PRESENCE | 4.5 | E | 23 |
| 224 | B | −51 | HYDROCHLORIC ACID + SULFURIC ACID | 69 | 14 | PRESENCE | 4.5 | E | 23 |
| 225 | B | −54 | HYDROCHLORIC ACID + SULFURIC ACID | 55 | 15 | PRESENCE | 4.5 | E | 23 |
| 226 | B | −52 | HYDROCHLORIC ACID + SULFURIC ACID | 66 | 19 | PRESENCE | 4.5 | E | 23 |
| 227 | B | −44 | HYDROCHLORIC ACID + SULFURIC ACID | 84 | 13 | PRESENCE | 4.5 | E | 23 |
| 228 | B | −41 | HYDROCHLORIC ACID + SULFURIC ACID | 75 | 16 | PRESENCE | 4.5 | E | 23 |
| 229 | B | −55 | HYDROCHLORIC ACID + SULFURIC ACID | 78 | 18 | PRESENCE | 4.5 | E | 23 |
| 230 | B | −54 | HYDROCHLORIC ACID + SULFURIC ACID | 65 | 17 | PRESENCE | 4.5 | E | 23 |

TABLE 7-continued

| | | | | | | | | | |
|---|---|---|---|---|---|---|---|---|---|
| 231 | B | −49 | HYDROCHLORIC ACID + SULFURIC ACID | 64 | 17 | PRESENCE | 4.5 | E | 23 |
| 232 | B | −45 | HYDROCHLORIC ACID + SULFURIC ACID | 79 | 12 | PRESENCE | 4.5 | E | 23 |
| 233 | B | −41 | HYDROCHLORIC ACID + SULFURIC ACID | 65 | 18 | PRESENCE | 4.5 | E | 23 |
| 234 | B | −42 | HYDROCHLORIC ACID + SULFURIC ACID | 78 | 16 | PRESENCE | 4.5 | E | 23 |
| 235 | B | −46 | HYDROCHLORIC ACID + SULFURIC ACID | 68 | 17 | PRESENCE | 4.5 | E | 23 |

| | WATER WASHING | | DRYING | | | | EVALUATION | | | |
|---|---|---|---|---|---|---|---|---|---|---|
| TEST No. | WATER TEMPERATURE (° C.) | WATER-WASHING TIME (SECOND) | TIME TO DRYING START (SECOND) | DRYING TEMPERATURE (° C.) | Ni PLATING | THICKNESS OF OXIDE FILM (μm) | CONVERSION TREATABILITY | THICKNESS OF DECARBURIZED LAYER | DECREASING ABILITY | REMARK |
| 188 | — | — | 5 | 40 | ABSENCE | UNMEASURABLE | W | E | W | COMPARATIVE EXAMPLE |
| 189 | 18 | 15 | 15 | 40 | ABSENCE | 47 | M | E | E | INVENTION EXAMPLE |
| 190 | 18 | 8 | 15 | 40 | ABSENCE | 42 | E | E | E | INVENTION EXAMPLE |
| 191 | 18 | 8 | 15 | 40 | ABSENCE | 40 | E | W | E | COMPARATIVE EXAMPLE |
| 192 | 18 | 8 | 30 | 40 | ABSENCE | 29 | E | E | E | INVENTION EXAMPLE |
| 193 | 18 | 8 | 30 | 40 | ABSENCE | 43 | E | E | E | INVENTION EXAMPLE |
| 194 | 18 | 8 | 30 | 40 | ABSENCE | 44 | M | E | E | INVENTION EXAMPLE |
| 195 | 18 | 8 | 30 | 40 | ABSENCE | 46 | M | E | E | INVENTION EXAMPLE |
| 196 | 18 | 8 | 30 | 40 | ABSENCE | 45 | W | E | E | COMPARATIVE EXAMPLE |
| 197 | 18 | 8 | 30 | 40 | ABSENCE | 46 | W | E | E | COMPARATIVE EXAMPLE |
| 198 | 18 | 8 | 30 | 40 | ABSENCE | 41 | E | E | E | INVENTION EXAMPLE |
| 199 | 18 | 10 | 30 | 40 | ABSENCE | 47 | M | E | E | INVENTION EXAMPLE |
| 200 | 18 | 15 | 30 | 40 | ABSENCE | 47 | M | E | E | INVENTION EXAMPLE |
| 201 | 18 | 17 | 30 | 40 | ABSENCE | 49 | W | E | E | COMPARATIVE EXAMPLE |
| 202 | 18 | 20 | 30 | 40 | ABSENCE | 50 | W | E | E | COMPARATIVE EXAMPLE |
| 203 | 18 | 30 | 30 | 40 | ABSENCE | 54 | W | E | E | COMPARATIVE EXAMPLE |
| 204 | 18 | 8 | 0 | 40 | ABSENCE | 38 | E | E | E | INVENTION EXAMPLE |
| 205 | 18 | 8 | 15 | 40 | ABSENCE | 43 | E | E | E | INVENTION EXAMPLE |
| 206 | 18 | 8 | 45 | 40 | ABSENCE | 47 | M | E | E | INVENTION EXAMPLE |
| 207 | 18 | 8 | 57 | 40 | ABSENCE | 51 | M | E | E | INVENTION EXAMPLE |
| 208 | 18 | 8 | 60 | 40 | ABSENCE | 50 | M | E | E | INVENTION EXAMPLE |
| 209 | 18 | 8 | 63 | 40 | ABSENCE | 50 | W | E | E | COMPARATIVE EXAMPLE |
| 210 | 18 | 8 | 70 | 40 | ABSENCE | 53 | W | E | E | COMPARATIVE EXAMPLE |
| 211 | 18 | 8 | 120 | 40 | ABSENCE | 62 | W | E | E | COMPARATTVE EXAMPLE |
| 212 | — | — | 5 | 40 | ABSENCE | UNMEASURABLE | W | E | W | COMPARATIVE EXAMPLE |
| 213 | 18 | 15 | 15 | 40 | ABSENCE | 47 | M | E | E | INVENTION EXAMPLE |
| 214 | 18 | 8 | 15 | 40 | ABSENCE | 40 | E | E | E | INVENTION EXAMPLE |
| 215 | 18 | 8 | 15 | 40 | ABSENCE | 42 | E | W | E | COMPARATIVE EXAMPLE |
| 216 | 18 | 8 | 30 | 40 | ABSENCE | 32 | E | E | E | INVENTION EXAMPLE |
| 217 | 18 | 8 | 30 | 40 | ABSENCE | 44 | E | E | E | INVENTION EXAMPLE |
| 218 | 18 | 8 | 30 | 40 | ABSENCE | 44 | M | E | E | INVENTION EXAMPLE |
| 219 | 18 | 8 | 30 | 40 | ABSENCE | 46 | M | E | E | INVENTION EXAMPLE |
| 220 | 18 | 8 | 30 | 40 | ABSENCE | 49 | W | E | E | COMPARATIVE EXAMPLE |
| 221 | 18 | 8 | 30 | 40 | ABSENCE | 45 | W | E | E | COMPARATIVE EXAMPLE |
| 222 | 18 | 3 | 30 | 40 | ABSENCE | 44 | M | E | E | INVENTION EXAMPLE |
| 223 | 18 | 10 | 30 | 40 | ABSENCE | 46 | M | E | E | INVENTION EXAMPLE |
| 224 | 18 | 15 | 30 | 40 | ABSENCE | 50 | M | E | E | INVENTION EXAMPLE |
| 225 | 18 | 17 | 30 | 40 | ABSENCE | 53 | W | E | E | COMPARATIVE EXAMPLE |

TABLE 7-continued

| | | | | | | | | | | |
|---|---|---|---|---|---|---|---|---|---|---|
| 226 | 18 | 20 | 30 | 40 | ABSENCE | 53 | W | E | E | COMPARATIVE EXAMPLE |
| 227 | 18 | 30 | 30 | 40 | ABSENCE | 59 | W | E | E | COMPARATIVE EXAMPLE |
| 228 | 18 | 8 | 0 | 40 | ABSENCE | 39 | E | E | E | INVENTION EXAMPLE |
| 229 | 18 | 8 | 15 | 40 | ABSENCE | 42 | M | E | E | INVENTION EXAMPLE |
| 230 | 18 | 8 | 45 | 40 | ABSENCE | 50 | M | E | E | INVENTION EXAMPLE |
| 231 | 18 | 8 | 57 | 40 | ABSENCE | 54 | M | E | E | INVENTION EXAMPLE |
| 232 | 18 | 8 | 60 | 40 | ABSENCE | 52 | M | E | E | INVENTION EXAMPLE |
| 233 | 18 | 8 | 63 | 40 | ABSENCE | 51 | W | E | E | COMPARATIVE EXAMPLE |
| 234 | 18 | 8 | 70 | 40 | ABSENCE | 55 | W | E | E | COMPARATIVE EXAMPLE |
| 235 | 18 | 8 | 120 | 40 | ABSENCE | 65 | W | E | E | COMPARATIVE EXAMPLE |

TABLE 8

| | | ANNEALING | PICKLING | | | WATER WASHING | | | | |
|---|---|---|---|---|---|---|---|---|---|---|
| | | | | | | | | WATER | | |
| TEST No. | STEEL TYPE | DEW POINT (° C.) | PICKLING SOLUTION | TEMPERATURE (° C.) | IMMERSION TIME (SECOND) | PRESENCE/ ABSENCE | CONDUCTIVITY (mS/m) | FORMULA 1 | VOLUME DENSITY (L/s · m$^2$) | WATER TEMPERATURE (° C.) |
| 236 | B | −40 | HYDROCHLORIC ACID + NITRIC ACID | 68 | 16 | ABSENCE | — | — | — | — |
| 237 | B | −40 | HYDROCHLORIC ACID + NITRIC ACID | 86 | 17 | PRESENCE | 2.9 | E | 23 | 18 |
| 238 | B | −35 | HYDROCHLORIC ACID + NITRIC ACID | 55 | 18 | PRESENCE | 2.9 | E | 23 | 18 |
| 239 | B | −33 | HYDROCHLORIC ACID + NITRIC ACID | 77 | 12 | PRESENCE | 2.9 | E | 23 | 18 |
| 240 | B | −47 | HYDROCHLORIC ACID + NITRIC ACID | 57 | 17 | PRESENCE | 0.22 | E | 23 | 18 |
| 241 | B | −49 | HYDROCHLORIC ACID + NITRIC ACID | 73 | 16 | PRESENCE | 2.9 | E | 23 | 18 |
| 242 | B | −41 | HYDROCHLORIC ACID + NITRIC ACID | 77 | 21 | PRESENCE | 4.5 | E | 23 | 18 |
| 243 | B | −47 | HYDROCHLORIC ACID + NITRIC ACID | 82 | 17 | PRESENCE | 5.0 | E | 23 | 18 |
| 244 | B | −41 | HYDROCHLORIC ACID + NITRIC ACID | 60 | 16 | PRESENCE | 5.2 | W | 23 | 18 |
| 245 | B | −49 | HYDROCHLORIC ACID + NITRIC ACID | 71 | 14 | PRESENCE | 5.5 | W | 23 | 18 |
| 246 | B | −41 | HYDROCHLORIC ACID + NITRIC ACID | 82 | 16 | PRESENCE | 2.9 | E | 23 | 18 |
| 247 | B | −46 | HYDROCHLORIC ACID + NITRIC ACID | 84 | 14 | PRESENCE | 2.9 | E | 23 | 18 |
| 248 | B | −45 | HYDROCHLORIC ACID + NITRIC ACID | 68 | 11 | PRESENCE | 2.9 | E | 23 | 18 |
| 249 | B | −43 | HYDROCHLORIC ACID + NITRIC ACID | 78 | 14 | PRESENCE | 2.9 | E | 23 | 18 |
| 250 | B | −51 | HYDROCHLORIC ACID + NITRIC ACID | 79 | 16 | PRESENCE | 2.9 | E | 23 | 18 |
| 251 | B | −48 | HYDROCHLORIC ACID + NITRIC ACID | 71 | 16 | PRESENCE | 2.9 | E | 23 | 18 |
| 252 | B | −44 | HYDROCHLORIC ACID + NITRIC ACID | 73 | 12 | PRESENCE | 2.9 | E | 23 | 18 |
| 253 | B | −42 | HYDROCHLORIC ACID + NITRIC ACID | 81 | 20 | PRESENCE | 2.9 | E | 23 | 18 |
| 254 | B | −50 | HYDROCHLORIC ACID + NITRIC ACID | 78 | 20 | PRESENCE | 2.9 | E | 23 | 18 |
| 255 | B | −55 | HYDROCHLORIC ACID + NITRIC ACID | 78 | 19 | PRESENCE | 2.9 | E | 23 | 18 |
| 256 | B | −47 | HYDROCHLORIC ACID + NITRIC ACID | 81 | 20 | PRESENCE | 2.9 | E | 23 | 18 |
| 257 | B | −46 | HYDROCHLORIC ACID + NITRIC ACID | 67 | 12 | PRESENCE | 2.9 | E | 23 | 18 |
| 258 | B | −52 | HYDROCHLORIC ACID + NITRIC ACID | 79 | 19 | PRESENCE | 2.9 | E | 23 | 18 |
| 259 | B | −52 | HYDROCHLORIC ACID + NITRIC ACID | 70 | 16 | PRESENCE | 2.9 | E | 23 | 18 |
| 260 | B | −40 | NITRIC ACID + SULFURIC ACID | 82 | 19 | ABSENCE | — | — | — | — |
| 261 | B | −40 | NITRIC ACID + SULFURIC ACID | 60 | 16 | PRESENCE | 2.9 | E | 23 | 18 |
| 262 | B | −35 | NITRIC ACID + SULFURIC ACID | 67 | 15 | PRESENCE | 2.9 | E | 23 | 18 |
| 263 | B | −33 | NITRIC ACID + SULFURIC ACID | 80 | 12 | PRESENCE | 2.9 | E | 23 | 18 |
| 264 | B | −45 | NITRIC ACID + SULFURIC ACID | 69 | 17 | PRESENCE | 0.22 | E | 23 | 18 |
| 265 | B | −45 | NITRIC ACID + SULFURIC ACID | 70 | 13 | PRESENCE | 2.9 | E | 23 | 18 |
| 266 | B | −54 | NITRIC ACID + SULFURIC ACID | 65 | 15 | PRESENCE | 4.5 | E | 23 | 18 |
| 267 | B | −40 | NITRIC ACID + SULFURIC ACID | 69 | 19 | PRESENCE | 5.0 | E | 23 | 18 |
| 268 | B | −40 | NITRIC ACID + SULFURIC ACID | 77 | 13 | PRESENCE | 5.2 | W | 23 | 18 |
| 269 | B | −49 | NITRIC ACID + SULFURIC ACID | 78 | 18 | PRESENCE | 5.5 | W | 23 | 18 |
| 270 | B | −46 | NITRIC ACID + SULFURIC ACID | 60 | 20 | PRESENCE | 4.5 | E | 23 | 18 |
| 271 | B | −44 | NITRIC ACID + SULFURIC ACID | 75 | 22 | PRESENCE | 4.5 | E | 23 | 18 |
| 272 | B | −40 | NITRIC ACID + SULFURIC ACID | 75 | 21 | PRESENCE | 4.5 | E | 23 | 18 |
| 273 | B | −50 | NITRIC ACID + SULFURIC ACID | 89 | 20 | PRESENCE | 4.5 | E | 23 | 18 |
| 274 | B | −46 | NITRIC ACID + SULFURIC ACID | 68 | 23 | PRESENCE | 4.5 | E | 23 | 18 |
| 275 | B | −51 | NITRIC ACID + SULFURIC ACID | 83 | 17 | PRESENCE | 4.5 | E | 23 | 18 |
| 276 | B | −49 | NITRIC ACID + SULFURIC ACID | 65 | 14 | PRESENCE | 4.5 | E | 23 | 18 |
| 277 | B | −42 | NITRIC ACID + SULFURIC ACID | 72 | 15 | PRESENCE | 4.5 | E | 23 | 18 |
| 278 | B | −42 | NITRIC ACID + SULFURIC ACID | 78 | 17 | PRESENCE | 4.5 | E | 23 | 18 |

TABLE 8-continued

| | | | | | | | | | | |
|---|---|---|---|---|---|---|---|---|---|---|
| 279 | B | −53 | NITRIC ACID + SULFURIC ACID | 75 | 9 | PRESENCE | 4.5 | E | 23 | 18 |
| 280 | B | −42 | NITRIC ACID + SULFURIC ACID | 80 | 17 | PRESENCE | 4.5 | E | 23 | 18 |
| 281 | B | −42 | NITRIC ACID + SULFURIC ACID | 78 | 11 | PRESENCE | 4.5 | E | 23 | 18 |
| 282 | B | −44 | NITRIC ACID + SULFURIC ACID | 88 | 14 | PRESENCE | 4.5 | E | 23 | 18 |
| 283 | B | −47 | NITRIC ACID + SULFURIC ACID | 69 | 19 | PRESENCE | 4.5 | E | 23 | 18 |

| | WATER WASHING | DRYING | | | | EVALUATION | | | |
|---|---|---|---|---|---|---|---|---|---|
| TEST No. | WATER-WASHING TIME (SECOND) | TIME TO DRYING START (SECOND) | DRYING TEMPERATURE (° C.) | Ni PLATING | THICKNESS OF OXIDE FILM (μm) | CONVERSION TREATABILITY | THICKNESS OF DECARBURIZED LAYER | DECREASING ABILITY | REMARK |
| 236 | — | 5 | 40 | ABSENCE | UNMEASURABLE | W | E | W | COMPARATIVE EXAMPLE |
| 237 | 15 | 15 | 40 | ABSENCE | 44 | M | E | E | INVENTION EXAMPLE |
| 238 | 8 | 15 | 40 | ABSENCE | 42 | E | E | E | INVENTION EXAMPLE |
| 239 | 8 | 15 | 40 | ABSENCE | 42 | E | W | E | COMPARATIVE EXAMPLE |
| 240 | 8 | 30 | 40 | ABSENCE | 31 | E | E | E | INVENTION EXAMPLE |
| 241 | 8 | 30 | 40 | ABSENCE | 44 | E | E | E | INVENTION EXAMPLE |
| 242 | 8 | 30 | 40 | ABSENCE | 48 | M | E | E | INVENTION EXAMPLE |
| 243 | 8 | 30 | 40 | ABSENCE | 46 | M | E | E | INVENTION EXAMPLE |
| 244 | 8 | 30 | 40 | ABSENCE | 46 | W | E | E | COMPARATIVE EXAMPLE |
| 245 | 8 | 30 | 40 | ABSENCE | 49 | W | E | E | COMPARATIVE EXAMPLE |
| 246 | 3 | 30 | 40 | ABSENCE | 43 | E | E | E | INVENTION EXAMPLE |
| 247 | 10 | 30 | 40 | ABSENCE | 46 | M | E | E | INVENTION EXAMPLE |
| 248 | 15 | 30 | 40 | ABSENCE | 47 | M | E | E | INVENTION EXAMPLE |
| 249 | 17 | 30 | 40 | ABSENCE | 48 | W | E | E | COMPARATIVE EXAMPLE |
| 250 | 20 | 30 | 40 | ABSENCE | 52 | W | E | E | COMPARATIVE EXAMPLE |
| 251 | 30 | 30 | 40 | ABSENCE | 53 | W | E | E | COMPARATIVE EXAMPLE |
| 252 | 8 | 0 | 40 | ABSENCE | 39 | E | E | E | INVENTION EXAMPLE |
| 253 | 8 | 15 | 40 | ABSENCE | 42 | E | E | E | INVENTION EXAMPLE |
| 254 | 8 | 45 | 40 | ABSENCE | 47 | M | E | E | INVENTION EXAMPLE |
| 255 | 8 | 57 | 40 | ABSENCE | 47 | M | E | E | INVENTION EXAMPLE |
| 256 | 8 | 60 | 40 | ABSENCE | 49 | M | E | E | INVENTION EXAMPLE |
| 257 | 8 | 63 | 40 | ABSENCE | 51 | W | E | E | COMPARATIVE EXAMPLE |
| 258 | 8 | 70 | 40 | ABSENCE | 54 | W | E | E | COMPARATIVE EXAMPLE |
| 259 | 8 | 120 | 40 | ABSENCE | 63 | W | E | E | COMPARATIVE EXAMPLE |
| 260 | — | 5 | 40 | ABSENCE | UNMEASURABLE | W | E | W | COMPARATIVE EXAMPLE |
| 261 | 15 | 15 | 40 | ABSENCE | 45 | M | E | E | INVENTION EXAMPLE |
| 262 | 8 | 15 | 40 | ABSENCE | 42 | E | E | E | INVENTION EXAMPLE |
| 263 | 8 | 15 | 40 | ABSENCE | 41 | E | W | E | COMPARATIVE EXAMPLE |
| 264 | 8 | 30 | 40 | ABSENCE | 31 | E | E | E | INVENTION EXAMPLE |
| 265 | 8 | 30 | 40 | ABSENCE | 43 | E | E | E | INVENTION EXAMPLE |
| 266 | 8 | 30 | 40 | ABSENCE | 47 | M | E | E | INVENTION EXAMPLE |
| 267 | 8 | 30 | 40 | ABSENCE | 48 | M | E | E | INVENTION EXAMPLE |
| 268 | 8 | 30 | 40 | ABSENCE | 46 | W | E | E | COMPARATIVE EXAMPLE |
| 269 | 8 | 30 | 40 | ABSENCE | 46 | W | E | E | COMPARATIVE EXAMPLE |
| 270 | 3 | 30 | 40 | ABSENCE | 43 | M | E | E | INVENTION EXAMPLE |
| 271 | 10 | 30 | 40 | ABSENCE | 48 | M | E | E | INVENTION EXAMPLE |
| 272 | 15 | 30 | 40 | ABSENCE | 49 | M | E | E | INVENTION EXAMPLE |
| 273 | 17 | 30 | 40 | ABSENCE | 51 | W | E | E | COMPARATIVE EXAMPLE |

TABLE 8-continued

| | | | | | | | | | |
|---|---|---|---|---|---|---|---|---|---|
| 274 | 20 | 30 | 40 | ABSENCE | 51 | W | E | E | COMPARATIVE EXAMPLE |
| 275 | 30 | 30 | 40 | ABSENCE | 56 | W | E | E | COMPARATIVE EXAMPLE |
| 276 | 8 | 8 | 40 | ABSENCE | 41 | E | E | E | INVENTION EXAMPLE |
| 277 | 8 | 15 | 40 | ABSENCE | 41 | M | E | E | INVENTION EXAMPLE |
| 278 | 8 | 45 | 40 | ABSENCE | 48 | M | E | E | INVENTION EXAMPLE |
| 279 | 8 | 57 | 40 | ABSENCE | 52 | M | E | E | INVENTION EXAMPLE |
| 280 | 8 | 60 | 40 | ABSENCE | 53 | M | E | E | INVENTION EXAMPLE |
| 281 | 8 | 63 | 40 | ABSENCE | 54 | W | E | E | COMPARATIVE EXAMPLE |
| 282 | 8 | 70 | 40 | ABSENCE | 56 | W | E | E | COMPARATIVE EXAMPLE |
| 283 | 8 | 120 | 40 | ABSENCE | 66 | W | E | E | COMPARATIVE EXAMPLE |

TABLE 9

| | | ANNEALING | PICKLING | | | WATER WASHING | | | | |
|---|---|---|---|---|---|---|---|---|---|---|
| | | | | | | | | WATER | | |
| TEST No. | STEEL TYPE | DEW POINT (° C.) | PICKLING SOLUTION | TEMPERATURE (° C.) | IMMERSION TIME (SECOND) | PRESENCE/ ABSENCE | CONDUCTIVITY (mS/m) | FORMULA 1 | VOLUME DENSITY (L/s · m$^2$) | WATER TEMPERATURE (° C.) |
| 284 | C | −40 | ABSENCE | ABSENCE | ABSENCE | ABSENCE | — | — | — | — |
| 285 | C | −40 | HYDROCHLORIC ACID | 64 | 20 | PRESENCE | 0.22 | E | 23 | 18 |
| 286 | C | −35 | HYDROCHLORIC ACID | 65 | 22 | PRESENCE | 0.22 | E | 23 | 18 |
| 287 | C | −33 | HYDROCHLORIC ACID | 82 | 19 | PRESENCE | 0.22 | E | 23 | 18 |
| 288 | C | −49 | HYDROCHLORIC ACID | 73 | 27 | PRESENCE | 0.22 | E | 23 | 18 |
| 289 | C | −44 | HYDROCHLORIC ACID | 83 | 17 | PRESENCE | 2.9 | E | 23 | 18 |
| 290 | C | −54 | HYDROCHLORIC ACID | 78 | 18 | PRESENCE | 4.5 | E | 23 | 18 |
| 291 | C | −55 | HYDROCHLORIC ACID | 72 | 22 | PRESENCE | 5.0 | E | 23 | 18 |
| 292 | C | −44 | HYDROCHLORIC ACID | 74 | 23 | PRESENCE | 5.2 | W | 23 | 18 |
| 293 | C | −54 | HYDROCHLORIC ACID | 68 | 17 | PRESENCE | 5.5 | W | 23 | 18 |
| 294 | C | −53 | HYDROCHLORIC ACID | 66 | 13 | PRESENCE | 0.22 | E | 23 | 18 |
| 295 | C | −52 | HYDROCHLORIC ACID | 82 | 14 | PRESENCE | 0.22 | E | 23 | 18 |
| 296 | C | −52 | HYDROCHLORIC ACID | 75 | 28 | PRESENCE | 0.22 | E | 23 | 18 |
| 297 | C | −54 | HYDROCHLORIC ACID | 66 | 16 | PRESENCE | 0.22 | E | 23 | 18 |
| 298 | C | −48 | HYDROCHLORIC ACID | 80 | 13 | PRESENCE | 0.22 | E | 23 | 18 |
| 299 | C | −46 | HYDROCHLORIC ACID | 80 | 23 | PRESENCE | 0.22 | E | 23 | 18 |
| 300 | C | −45 | HYDROCHLORIC ACID | 71 | 15 | PRESENCE | 0.22 | E | 23 | 18 |
| 301 | C | −51 | HYDROCHLORIC ACID | 72 | 20 | PRESENCE | 0.22 | E | 23 | 18 |
| 302 | C | −47 | HYDROCHLORIC ACID | 73 | 22 | PRESENCE | 0.22 | E | 23 | 18 |
| 303 | C | −50 | HYDROCHLORIC ACID | 76 | 26 | PRESENCE | 0.22 | E | 23 | 18 |
| 304 | C | −47 | HYDROCHLORIC ACID | 73 | 21 | PRESENCE | 0.22 | E | 23 | 18 |
| 305 | C | −44 | HYDROCHLORIC ACID | 78 | 19 | PRESENCE | 0.22 | E | 23 | 18 |
| 306 | C | −43 | HYDROCHLORIC ACID | 72 | 19 | PRESENCE | 0.22 | E | 23 | 18 |
| 307 | C | −46 | HYDROCHLORIC ACID | 67 | 24 | PRESENCE | 0.22 | E | 23 | 18 |
| 308 | C | −40 | SULFURIC ACID | 89 | 26 | ABSENCE | — | — | — | — |
| 309 | C | −40 | SULFURIC ACID | 74 | 25 | PRESENCE | 0.22 | E | 23 | 18 |
| 310 | C | −35 | SULFURIC ACID | 75 | 18 | PRESENCE | 0.22 | E | 23 | 18 |
| 311 | C | −33 | SULFURIC ACID | 79 | 15 | PRESENCE | 0.22 | E | 23 | 18 |
| 312 | C | −42 | SULFURIC ACID | 68 | 21 | PRESENCE | 0.22 | E | 23 | 18 |
| 313 | C | −45 | SULFURIC ACID | 72 | 16 | PRESENCE | 2.9 | E | 23 | 18 |
| 314 | C | −54 | SULFURIC ACID | 75 | 26 | PRESENCE | 4.5 | E | 23 | 18 |
| 315 | C | −43 | SULFURIC ACID | 66 | 21 | PRESENCE | 5.0 | E | 23 | 18 |
| 316 | C | −47 | SULFURIC ACID | 65 | 19 | PRESENCE | 5.2 | W | 23 | 18 |
| 317 | C | −41 | SULFURIC ACID | 73 | 22 | PRESENCE | 5.5 | W | 23 | 18 |
| 318 | C | −46 | SULFURIC ACID | 70 | 16 | PRESENCE | 0.22 | E | 23 | 18 |
| 319 | C | −47 | SULFURIC ACID | 78 | 19 | PRESENCE | 0.22 | E | 23 | 18 |
| 320 | C | −43 | SULFURIC ACID | 74 | 28 | PRESENCE | 0.22 | E | 23 | 18 |
| 321 | C | −41 | SULFURIC ACID | 72 | 22 | PRESENCE | 0.22 | E | 23 | 18 |
| 322 | C | −48 | SULFURIC ACID | 89 | 16 | PRESENCE | 0.22 | E | 23 | 18 |
| 323 | C | −50 | SULFURIC ACID | 65 | 18 | PRESENCE | 0.22 | E | 23 | 18 |
| 324 | C | −50 | SULFURIC ACID | 81 | 17 | PRESENCE | 0.22 | E | 23 | 18 |
| 325 | C | −47 | SULFURIC ACID | 63 | 27 | PRESENCE | 0.22 | E | 23 | 18 |
| 326 | C | −44 | SULFURIC ACID | 83 | 21 | PRESENCE | 0.22 | E | 23 | 18 |

TABLE 9-continued

| | | | | | | | | | | |
|---|---|---|---|---|---|---|---|---|---|---|
| 327 | C | −55 | SULFURIC ACID | 68 | 17 | PRESENCE | 0.22 | E | 23 | 18 |
| 328 | C | −50 | SULFURIC ACID | 79 | 18 | PRESENCE | 0.22 | E | 23 | 18 |
| 329 | C | −48 | SULFURIC ACID | 65 | 17 | PRESENCE | 0.22 | E | 23 | 18 |
| 330 | C | −55 | SULFURIC ACID | 68 | 20 | PRESENCE | 0.22 | E | 23 | 18 |
| 331 | C | −54 | SULFURIC ACID | 73 | 11 | PRESENCE | 0.22 | E | 23 | 18 |

| | WATER WASHING | DRYING | | | | EVALUATION | | | |
|---|---|---|---|---|---|---|---|---|---|
| TEST No. | WATER-WASHING TIME (SECOND) | TIME TO DRYING START (SECOND) | DRYING TEMPERATURE (° C.) | Ni PLATING | THICKNESS OF OXIDE FILM (μm) | CONVERSION TREATABILITY | THICKNESS OF DECARBURIZED LAYER | DECREASING ABILITY | REMARK |
| 284 | — | 5 | 40 | ABSENCE | UNMEASURABLE | W | E | E | COMPARATIVE EXAMPLE |
| 285 | 2 | 10 | 40 | ABSENCE | 25 | M | E | E | INVENTION EXAMPLE |
| 286 | 2 | 10 | 40 | ABSENCE | 26 | E | E | E | INVENTION EXAMPLE |
| 287 | 2 | 0 | 40 | ABSENCE | 26 | E | W | E | COMPARATIVE EXAMPLE |
| 288 | 2 | 0 | 40 | ABSENCE | 26 | E | E | E | INVENTION EXAMPLE |
| 289 | 2 | 0 | 40 | ABSENCE | 36 | M | E | E | INVENTION EXAMPLE |
| 290 | 2 | 0 | 40 | ABSENCE | 38 | M | E | E | INVENTION EXAMPLE |
| 291 | 2 | 0 | 40 | ABSENCE | 40 | M | E | E | INVENTION EXAMPLE |
| 292 | 2 | 0 | 40 | ABSENCE | 39 | W | E | E | COMPARATIVE EXAMPLE |
| 293 | 2 | 0 | 40 | ABSENCE | 37 | W | E | E | COMPARATIVE EXAMPLE |
| 294 | 3 | 10 | 40 | ABSENCE | 26 | E | E | E | INVENTION EXAMPLE |
| 295 | 10 | 10 | 40 | ABSENCE | 28 | M | E | E | INVENTION EXAMPLE |
| 296 | 15 | 10 | 40 | ABSENCE | 34 | M | E | E | INVENTION EXAMPLE |
| 297 | 17 | 10 | 40 | ABSENCE | 35 | W | E | E | COMPARATIVE EXAMPLE |
| 298 | 20 | 10 | 40 | ABSENCE | 33 | W | E | E | COMPARATIVE EXAMPLE |
| 299 | 30 | 10 | 40 | ABSENCE | 41 | W | E | E | COMPARATIVE EXAMPLE |
| 300 | 4 | 0 | 40 | ABSENCE | 23 | E | E | E | INVENTION EXAMPLE |
| 301 | 4 | 15 | 40 | ABSENCE | 25 | M | E | E | INVENTION EXAMPLE |
| 302 | 4 | 45 | 40 | ABSENCE | 32 | M | E | E | INVENTION EXAMPLE |
| 303 | 4 | 57 | 40 | ABSENCE | 32 | M | E | E | INVENTION EXAMPLE |
| 304 | 4 | 60 | 40 | ABSENCE | 35 | M | E | E | INVENTION EXAMPLE |
| 305 | 4 | 63 | 40 | ABSENCE | 34 | W | E | E | COMPARATIYE EXAMPLE |
| 306 | 4 | 70 | 40 | ABSENCE | 35 | W | E | E | COMPARATIVE EXAMPLE |
| 307 | 4 | 120 | 40 | ABSENCE | 41 | W | E | E | COMPARATIVE EXAMPLE |
| 308 | — | 45 | 40 | ABSENCE | UNMEASURABLE | W | E | W | COMPARATIVE EXAMPLE |
| 309 | 2 | 10 | 40 | ABSENCE | 26 | M | E | E | INVENTION EXAMPLE |
| 310 | 2 | 10 | 40 | ABSENCE | 26 | E | E | E | INVENTION EXAMPLE |
| 311 | 2 | 0 | 40 | ABSENCE | 25 | E | W | E | COMPARATIVE EXAMPLE |
| 312 | 2 | 0 | 40 | ABSENCE | 23 | E | E | E | INVENTION EXAMPLE |
| 313 | 2 | 0 | 40 | ABSENCE | 35 | M | E | E | INVENTION EXAMPLE |
| 314 | 2 | 0 | 40 | ABSENCE | 35 | M | E | E | INVENTION EXAMPLE |
| 315 | 2 | 0 | 40 | ABSENCE | 37 | M | E | E | INVENTION EXAMPLE |
| 316 | 2 | 0 | 40 | ABSENCE | 40 | W | E | E | COMPARATIVE EXAMPLE |
| 317 | 2 | 0 | 40 | ABSENCE | 40 | W | E | E | COMPARATIVE EXAMPLE |
| 318 | 3 | 10 | 40 | ABSENCE | 25 | E | E | E | INVENTION EXAMPLE |
| 319 | 10 | 10 | 40 | ABSENCE | 28 | M | E | E | INVENTION EXAMPLE |
| 320 | 15 | 10 | 40 | ABSENCE | 32 | M | E | E | INVENTION EXAMPLE |
| 321 | 17 | 10 | 40 | ABSENCE | 33 | W | E | E | COMPARATIVE EXAMPLE |

TABLE 9-continued

| | | | | | | | | | |
|---|---|---|---|---|---|---|---|---|---|
| 322 | 20 | 10 | 40 | ABSENCE | 35 | W | E | E | COMPARATIVE EXAMPLE |
| 323 | 30 | 10 | 40 | ABSENCE | 39 | W | E | E | COMPARATIVE EXAMPLE |
| 324 | 4 | 0 | 40 | ABSENCE | 25 | E | E | E | INVENTION EXAMPLE |
| 325 | 4 | 15 | 40 | ABSENCE | 26 | M | E | E | INVENTION EXAMPLE |
| 326 | 4 | 45 | 40 | ABSENCE | 32 | M | E | E | INVENTION EXAMPLE |
| 327 | 4 | 57 | 40 | ABSENCE | 35 | M | E | E | INVENTION EXAMPLE |
| 328 | 4 | 60 | 40 | ABSENCE | 34 | M | E | E | INVENTION EXAMPLE |
| 329 | 4 | 63 | 40 | ABSENCE | 33 | W | E | E | COMPARATIVE EXAMPLE |
| 330 | 4 | 70 | 40 | ABSENCE | 33 | W | E | E | COMPARATIVE EXAMPLE |
| 331 | 4 | 120 | 40 | ABSENCE | 41 | W | E | E | COMPARATIVE EXAMPLE |

TABLE 10

| | | ANNEALING | PICKLING | | | WATER WASHING | | | |
|---|---|---|---|---|---|---|---|---|---|
| TEST No. | STEEL TYPE | DEW POINT (° C.) | PICKLING SOLUTION | TEMPERATURE (° C.) | IMMERSION TIME (SECOND) | PRESENCE/ ABSENCE | CONDUCTIVITY (mS/m) | FORMULA 1 | WATER VOLUME DENSITY (L/s · m$^2$) |
| 332 | C | −40 | NITRIC ACID | 81 | 25 | ABSENCE | — | — | — |
| 333 | C | −40 | NITRIC ACID | 77 | 19 | PRESENCE | 0.22 | E | 23 |
| 334 | C | −35 | NITRIC ACID | 67 | 21 | PRESENCE | 0.22 | E | 23 |
| 335 | C | −33 | NITRIC ACID | 68 | 15 | PRESENCE | 0.22 | E | 23 |
| 336 | C | −52 | NITRIC ACID | 74 | 19 | PRESENCE | 0.22 | E | 23 |
| 337 | C | −48 | NITRIC ACID | 81 | 24 | PRESENCE | 2.9 | E | 23 |
| 338 | C | −53 | NITRIC ACID | 70 | 25 | PRESENCE | 4.5 | E | 23 |
| 339 | C | −46 | NITRIC ACID | 71 | 23 | PRESENCE | 5.0 | E | 23 |
| 340 | C | −42 | NITRIC ACID | 68 | 23 | PRESENCE | 5.2 | W | 23 |
| 341 | C | −52 | NITRIC ACID | 86 | 22 | PRESENCE | 5.5 | W | 23 |
| 342 | C | −45 | NITRIC ACID | 76 | 13 | PRESENCE | 0.22 | E | 23 |
| 343 | C | −41 | NTTRIC ACID | 71 | 19 | PRESENCE | 0.22 | E | 23 |
| 344 | C | −41 | NITRIC ACID | 78 | 20 | PRESENCE | 0.22 | E | 23 |
| 345 | C | −43 | NITRIC ACID | 66 | 24 | PRESENCE | 0.22 | E | 23 |
| 346 | C | −41 | NITRIC ACID | 70 | 24 | PRESENCE | 0.22 | E | 23 |
| 347 | C | −54 | NITRIC ACID | 81 | 21 | PRESENCE | 0.22 | E | 23 |
| 348 | C | −49 | NITRIC ACID | 70 | 22 | PRESENCE | 0.22 | E | 23 |
| 349 | C | −47 | NITRIC ACID | 83 | 17 | PRESENCE | 0.22 | E | 23 |
| 350 | C | −52 | NITRIC ACID | 72 | 16 | PRESENCE | 0.22 | E | 23 |
| 351 | C | −55 | NITRIC ACID | 83 | 23 | PRESENCE | 0.22 | E | 23 |
| 352 | C | −42 | NITRIC ACID | 78 | 17 | PRESENCE | 0.22 | E | 23 |
| 353 | C | −42 | NITRIC ACID | 76 | 23 | PRESENCE | 0.22 | E | 23 |
| 354 | C | −50 | NITRIC ACID | 65 | 16 | PRESENCE | 0.22 | E | 23 |
| 355 | C | −47 | NITRIC ACID | 64 | 19 | PRESENCE | 0.22 | E | 23 |
| 356 | C | −40 | HYDROCHLORIC ACID + SULFURIC ACID | 66 | 16 | ABSENCE | — | — | — |
| 357 | C | −40 | HYDROCHLORIC ACID + SULFURIC ACID | 74 | 19 | PRESENCE | 0.22 | E | 23 |
| 358 | C | −35 | HYDROCHLORIC ACID + SULFURIC ACID | 76 | 15 | PRESENCE | 0.22 | E | 23 |
| 359 | C | −33 | HYDROCHLORIC ACID + SULFURIC ACID | 76 | 22 | PRESENCE | 0.22 | E | 23 |
| 360 | C | −40 | HYDROCHLORIC ACID + SULFURIC ACID | 88 | 16 | PRESENCE | 0.22 | E | 23 |
| 361 | C | −45 | HYDROCHLORIC ACID + SULFURIC ACID | 82 | 16 | PRESENCE | 2.9 | E | 23 |
| 362 | C | −51 | HYDROCHLORIC ACID + SULFURIC ACID | 76 | 20 | PRESENCE | 4.5 | E | 23 |
| 363 | C | −41 | HYDROCHLORIC ACID + SULFURIC ACID | 65 | 21 | PRESENCE | 5.0 | E | 23 |
| 364 | C | −45 | HYDROCHLORIC ACID + SULFURIC ACID | 72 | 23 | PRESENCE | 5.2 | W | 23 |
| 365 | C | −42 | HYDROCHLORIC ACID + SULFURIC ACID | 84 | 23 | PRESENCE | 5.5 | W | 23 |
| 366 | C | −47 | HYDROCHLORIC ACID + SULFURIC ACID | 69 | 14 | PRESENCE | 0.22 | E | 23 |
| 367 | C | −50 | HYDROCHLORIC ACID + SULFURIC ACID | 77 | 21 | PRESENCE | 0.22 | E | 23 |
| 368 | C | −43 | HYDROCHLORIC ACID + SULFURIC ACID | 63 | 13 | PRESENCE | 0.22 | E | 23 |
| 369 | C | −48 | HYDROCHLORIC ACID + SULFURIC ACID | 76 | 28 | PRESENCE | 0.22 | E | 23 |
| 370 | C | −45 | HYDROCHLORIC ACID + SULFURIC ACID | 70 | 17 | PRESENCE | 0.22 | E | 23 |
| 371 | C | −42 | HYDROCHLORIC ACID + SULFURIC ACID | 75 | 20 | PRESENCE | 0.22 | E | 23 |
| 372 | C | −49 | HYDROCHLORIC ACID + SULFURIC ACID | 73 | 16 | PRESENCE | 0.22 | E | 23 |
| 373 | C | −52 | HYDROCHLORIC ACID + SULFURIC ACID | 80 | 17 | PRESENCE | 0.22 | E | 23 |
| 374 | C | −50 | HYDROCHLORIC ACID + SULFURIC ACID | 72 | 14 | PRESENCE | 0.22 | E | 23 |

TABLE 10-continued

| | | | | | | | | | |
|---|---|---|---|---|---|---|---|---|---|
| 375 | C | −55 | HYDROCHLORIC ACID + SULFURIC ACID | 82 | 13 | PRESENCE | 0.22 | E | 23 |
| 376 | C | −45 | HYDROCHLORIC ACID + SULFURIC ACID | 71 | 18 | PRESENCE | 0.22 | E | 23 |
| 377 | C | −54 | HYDROCHLORIC ACID + SULFURIC ACID | 71 | 13 | PRESENCE | 0.22 | E | 23 |
| 378 | C | −47 | HYDROCHLORIC ACID + SULFURIC ACID | 85 | 18 | PRESENCE | 0.22 | E | 23 |
| 379 | C | −40 | HYDROCHLORIC ACID + SULFURIC ACID | 73 | 20 | PRESENCE | 0.22 | E | 23 |

| | WATER WASHING | | DRYING | | | | EVALUATION | | | |
|---|---|---|---|---|---|---|---|---|---|---|
| TEST No. | WATER TEMPERATURE (° C.) | WATER-WASHING TIME (SECOND) | TIME TO DRYING START (SECOND) | DRYING TEMPERATURE (° C.) | Ni PLATING | THICKNESS OF OXIDE FILM | CONVERSION TREATABILITY | THICKNESS OF DECARBURIZED LAYER | DECREASING ABILITY | REMARK |
| 332 | — | — | 45 | 40 | ABSENCE | UNMEASURABLE | W | E | W | COMPARATIVE EXAMPLE |
| 333 | 18 | 2 | 10 | 40 | ABSENCE | 25 | E | E | E | INVENTION EXAMPLE |
| 334 | 18 | 2 | 10 | 40 | ABSENCE | 24 | E | E | E | INVENTION EXAMPLE |
| 335 | 18 | 2 | 0 | 40 | ABSENCE | 23 | E | W | E | COMPARATIVE EXAMPLE |
| 336 | 18 | 2 | 0 | 40 | ABSENCE | 25 | E | E | E | INTENTION EXAMPLE |
| 337 | 18 | 2 | 0 | 40 | ABSENCE | 34 | M | E | E | INVENTION EXAMPLE |
| 338 | 18 | 2 | 0 | 40 | ABSENCE | 36 | M | E | E | INVENTION EXAMPLE |
| 339 | 18 | 2 | 0 | 40 | ABSENCE | 36 | M | E | E | INVENTION EXAMPLE |
| 340 | 18 | 2 | 0 | 40 | ABSENCE | 40 | W | E | E | COMPARATIVE EXAMPLE |
| 341 | 18 | 2 | 0 | 40 | ABSENCE | 36 | W | E | E | COMPARATIVE EXAMPLE |
| 342 | 18 | 3 | 10 | 40 | ABSENCE | 26 | E | E | E | INVENTION EXAMPLE |
| 343 | 18 | 10 | 10 | 40 | ABSENCE | 30 | M | E | E | INVENTION EXAMPLE |
| 344 | 18 | 15 | 10 | 40 | ABSENCE | 31 | M | E | E | INVENTION EXAMPLE |
| 345 | 18 | 17 | 10 | 40 | ABSENCE | 31 | W | E | E | COMPARATIVE EXAMPLE |
| 346 | 18 | 20 | 10 | 40 | ABSENCE | 36 | W | E | E | COMPARATIVE EXAMPLE |
| 347 | 18 | 30 | 10 | 40 | ABSENCE | 39 | W | E | E | COMPARATIVE EXAMPLE |
| 348 | 18 | 4 | 0 | 40 | ABSENCE | 25 | E | E | E | INVENTION EXAMPLE |
| 349 | 18 | 4 | 15 | 40 | ABSENCE | 29 | M | E | E | INVENTION EXAMPLE |
| 350 | 18 | 4 | 45 | 40 | ABSENCE | 30 | M | E | E | INVENTION EXAMPLE |
| 351 | 18 | 4 | 57 | 40 | ABSENCE | 31 | M | E | E | INVENTION EXAMPLE |
| 352 | 18 | 4 | 60 | 40 | ABSENCE | 31 | M | E | E | INVENTION EXAMPLE |
| 353 | 18 | 4 | 63 | 40 | ABSENCE | 34 | W | E | E | COMPARATIVE EXAMPLE |
| 354 | 18 | 4 | 70 | 40 | ABSENCE | 32 | W | E | E | COMPARATIVE EXAMPLE |
| 355 | 18 | 4 | 120 | 40 | ABSENCE | 42 | W | E | E | COMPARATIVE EXAMPLE |
| 356 | — | — | 45 | 40 | ABSENCE | UNMEASURABLE | W | E | W | COMPARATIVE EXAMPLE |
| 357 | 18 | 2 | 10 | 40 | ABSENCE | 27 | M | E | E | INVENTION EXAMPLE |
| 358 | 18 | 2 | 10 | 40 | ABSENCE | 25 | E | E | E | INVENTION EXAMPLE |
| 359 | 18 | 2 | 0 | 40 | ABSENCE | 23 | E | W | E | COMPARATIVE EXAMPLE |
| 360 | 18 | 2 | 0 | 40 | ABSENCE | 25 | E | E | E | INVENTION EXAMPLE |
| 361 | 18 | 2 | 0 | 40 | ABSENCE | 35 | M | E | E | INVENTION EXAMPLE |
| 362 | 18 | 2 | 0 | 40 | ABSENCE | 36 | M | E | E | INVENTION EXAMPLE |
| 363 | 18 | 2 | 0 | 40 | ABSENCE | 36 | M | E | E | INVENTION EXAMPLE |
| 364 | 18 | 2 | 0 | 40 | ABSENCE | 37 | W | E | E | COMPARATIVE EXAMPLE |
| 365 | 18 | 2 | 0 | 40 | ABSENCE | 36 | W | E | E | COMPARATIVE EXAMPLE |
| 366 | 18 | 3 | 10 | 40 | ABSENCE | 27 | E | E | E | INVENTION EXAMPLE |
| 367 | 18 | 10 | 10 | 40 | ABSENCE | 29 | M | E | E | INVENTION EXAMPLE |
| 368 | 18 | 15 | 10 | 40 | ABSENCE | 32 | M | E | E | INVENION EXAMPLE |
| 369 | 18 | 17 | 10 | 40 | ABSENCE | 31 | W | E | E | COMPARATIVE EXAMPLE |

TABLE 10-continued

| | | | | | | | | | | |
|---|---|---|---|---|---|---|---|---|---|---|
| 370 | 18 | 20 | 10 | 40 | ABSENCE | 36 | W | E | E | COMPARATIVE EXAMPLE |
| 371 | 18 | 30 | 10 | 40 | ABSENCE | 38 | W | E | E | COMPARATIVE EXAMPLE |
| 372 | 18 | 4 | 0 | 40 | ABSENCE | 27 | E | E | E | INVENTION EXAMPLE |
| 373 | 18 | 4 | 15 | 40 | ABSENCE | 23 | M | E | E | INVENTION EXAMPLE |
| 374 | 18 | 4 | 45 | 40 | ABSENCE | 30 | M | E | E | INVENTION EXAMPLE |
| 375 | 18 | 4 | 57 | 40 | ABSENCE | 35 | M | E | E | INTENTION EXAMPLE |
| 376 | 18 | 4 | 60 | 40 | ABSENCE | 33 | M | E | E | INVENTION EXAMPLE |
| 377 | 18 | 4 | 63 | 40 | ABSENCE | 33 | W | E | E | COMPARATIVE EXAMPLE |
| 378 | 18 | 4 | 70 | 40 | ABSENCe | 32 | W | E | E | COMPARATIVE EXAMPLE |
| 379 | 18 | 4 | 120 | 40 | ABSENCE | 42 | W | E | E | COMPARATIVE EXAMPLE |

TABLE 11

| | | ANNEALING | PICKLING | | | WATER WASHING | | | |
|---|---|---|---|---|---|---|---|---|---|
| TEST No. | STEEL TYPE | DEW POINT (° C.) | PICKLING SOLUTION | TEMPERATURE (° C.) | IMMERSION TIME (SECOND) | PRESENCE/ ABSENCE | CONDUCTIVTIY (mS/m) | FORMULA 1 | WATER VOLUME DENSITY (L/s · m$^2$) |
| 380 | C | −40 | HYDROCHLORIC ACID + NITRIC ACID | 68 | 14 | ABSENCE | — | — | — |
| 381 | C | −40 | HYDROCHLORIC ACID + NITRIC ACID | 71 | 22 | PRESENCE | 0.22 | E | 23 |
| 382 | C | −35 | HYDROCHLORIC ACID + NITRIC ACID | 71 | 18 | PRESENCE | 0.22 | E | 23 |
| 383 | C | −33 | HYDROCHLORIC ACID + NITRIC ACID | 75 | 15 | PRESENCE | 0.22 | E | 23 |
| 384 | C | −53 | HYDROCHLORIC ACID + NITRIC ACID | 84 | 21 | PRESENCE | 0.22 | E | 23 |
| 385 | C | −43 | HYDROCHLORIC ACID + NITRIC ACID | 72 | 14 | PRESENCE | 2.9 | E | 23 |
| 386 | C | −40 | HYDROCHLORIC ACID + NITRIC ACID | 65 | 25 | PRESENCE | 4.5 | E | 23 |
| 387 | C | −50 | HYDROCHLORIC ACID + NITRIC ACID | 83 | 14 | PRESENCE | 5.0 | E | 23 |
| 388 | C | −44 | HYDROCHLORIC ACID + NITRIC ACID | 67 | 22 | PRESENCE | 5.2 | W | 23 |
| 389 | C | −42 | HYDROCHLORIC ACID + NITRIC ACID | 73 | 17 | PRESENCE | 5.5 | W | 23 |
| 390 | C | −51 | HYDROCHLORIC ACID + NITRIC ACID | 82 | 17 | PRESENCE | 0.22 | E | 23 |
| 391 | C | −54 | HYDROCHLORIC ACID + NITRIC ACID | 85 | 19 | PRESENCE | 0.22 | E | 23 |
| 392 | C | −44 | HYDROCHLORIC ACID + NITRIC ACID | 66 | 21 | PRESENCE | 0.22 | E | 23 |
| 393 | C | −45 | HYDROCHLORIC ACID + NITRIC ACID | 75 | 16 | PRESENCE | 0.22 | E | 23 |
| 394 | C | −52 | HYDROCHLORIC ACID + NITRIC ACID | 67 | 25 | PRESENCE | 0.22 | E | 23 |
| 395 | C | −45 | HYDROCHLORIC ACID + NITRIC ACID | 78 | 20 | PRESENCE | 0.22 | E | 23 |
| 396 | C | −42 | HYDROCHLORIC ACID + NITRIC ACID | 77 | 22 | PRESENCE | 0.22 | E | 23 |
| 397 | C | −43 | HYDROCHLORIC ACID + NITRIC ACID | 77 | 23 | PRESENCE | 0.22 | E | 23 |
| 398 | C | −49 | HYDROCHLORIC ACID + NITRIC ACID | 88 | 11 | PRESENCE | 0.22 | E | 23 |
| 399 | C | −55 | HYDROCHLORIC ACID + NITRIC ACID | 66 | 26 | PRESENCE | 0.22 | E | 23 |
| 400 | C | −41 | HYDROCHLORIC ACID + NITRIC ACID | 84 | 20 | PRESENCE | 0.22 | E | 23 |
| 401 | C | −54 | HYDROCHLORIC ACID + NITRIC ACID | 74 | 13 | PRESENCE | 0.22 | E | 23 |
| 402 | C | −53 | HYDROCHLORIC ACID + NITRIC ACID | 78 | 24 | PRESENCE | 0.22 | E | 23 |
| 403 | C | −52 | HYDROCHLORIC ACID + NITRIC ACID | 79 | 29 | PRESENCE | 0.22 | E | 23 |
| 404 | C | −40 | NITRIC ACID + SULFURIC ACID | 79 | 26 | ABSENCE | — | — | — |
| 405 | C | −40 | NITRIC ACID + SULFURIC ACID | 70 | 20 | PRESENCE | 0.22 | E | 23 |
| 406 | C | −35 | NITRIC ACID + SULFURIC ACID | 77 | 25 | PRESENCE | 0.22 | E | 23 |
| 407 | C | −33 | NITRIC ACID + SULFURIC ACID | 74 | 20 | PRESENCE | 0.22 | E | 23 |
| 408 | C | −42 | NITRIC ACID + SULFURIC ACID | 78 | 27 | PRESENCE | 0.22 | E | 23 |
| 409 | C | −44 | NITRIC ACID + SULFURIC ACID | 74 | 22 | PRESENCE | 2.9 | E | 23 |
| 410 | C | −49 | NITRIC ACID + SULFURIC ACID | 72 | 17 | PRESENCE | 4.5 | E | 23 |
| 411 | C | −45 | NITRIC ACID + SULFURIC ACID | 81 | 18 | PRESENCE | 5.0 | E | 23 |
| 412 | C | −54 | NITRIC ACID + SULFURIC ACID | 70 | 17 | PRESENCE | 5.2 | W | 23 |
| 413 | C | −46 | NITRIC ACID + SULFURIC ACID | 76 | 19 | PRESENCE | 5.5 | W | 23 |
| 414 | C | −43 | NITRIC ACID + SULFURIC ACID | 76 | 19 | PRESENCE | 0.22 | E | 23 |
| 415 | C | −42 | NITRIC ACID + SULFURIC ACID | 70 | 24 | PRESENCE | 0.22 | E | 23 |
| 416 | C | −53 | NITRIC ACID + SULFURIC ACID | 78 | 23 | PRESENCE | 0.22 | E | 23 |
| 417 | C | −48 | NITRIC ACID + SULFURIC ACID | 69 | 24 | PRESENCE | 0.22 | E | 23 |
| 418 | C | −55 | NITRIC ACID + SULFURIC ACID | 74 | 16 | PRESENCE | 0.22 | E | 23 |
| 419 | C | −50 | NITRIC ACID + SULFURIC ACID | 86 | 16 | PRESENCE | 0.22 | E | 23 |
| 420 | C | −43 | NITRIC ACID + SULFURIC ACID | 72 | 16 | PRESENCE | 0.22 | E | 23 |
| 421 | C | −48 | NITRIC ACID + SULFURIC ACID | 79 | 17 | PRESENCE | 0.22 | E | 23 |
| 422 | C | −46 | NITRIC ACID + SULFURIC ACID | 82 | 18 | PRESENCE | 0.22 | E | 23 |

TABLE 11-continued

| | | | | | | | | | |
|---|---|---|---|---|---|---|---|---|---|
| 423 | C | −55 | NITRIC ACID + SULFURIC ACID | 75 | 26 | PRESENCE | 0.22 | E | 23 |
| 424 | C | −52 | NITRIC ACID + SULFURIC ACID | 79 | 13 | PRESENCE | 0.22 | E | 23 |
| 425 | C | −52 | NITRIC ACID + SULFURIC ACID | 85 | 11 | PRESENCE | 0.22 | E | 23 |
| 426 | C | −45 | NITRIC ACID + SULFURIC ACID | 68 | 26 | PRESENCE | 0.22 | E | 23 |
| 427 | C | −40 | NITRIC ACID + SULFURIC ACID | 72 | 25 | PRESENCE | 0.22 | E | 23 |
| 428 | D | −40 | HYDROCHLORIC ACID | 60 | 10 | PRESENCE | 0.22 | E | 23 |
| 429 | E | −40 | HYDROCHLORIC ACID | 81 | 25 | PRESENCE | 0.22 | E | 23 |

| | WATER WASHING | | DRYING | | | | EVALUATION | | | |
|---|---|---|---|---|---|---|---|---|---|---|
| TEST No. | WATER TEMPERATURE (° C.) | WATER-WASHING TIME (SECOND) | TIME TO DRYING START (SECOND) | DRYING TEMPERATURE (° C.) | Ni PLATING | THICKNESS OF OXIDE FILM (μm) | CONVERSION TREATABILITY | THICKNESS OF DECARBURIZED LAYER | DECREASING ABILITY | REMARK |
| 380 | — | — | 45 | 40 | ABSENCE | UNMEASURABLE | W | E | W | COMPARATIVE EXAMPLE |
| 381 | 18 | 2 | 10 | 40 | ABSENCE | 27 | M | E | E | INVENTION EXAMPLE |
| 382 | 18 | 2 | 10 | 40 | ABSENCE | 25 | E | E | E | INVENTION EXAMPLE |
| 383 | 18 | 2 | 0 | 40 | ABSENCE | 23 | E | W | E | COMPARATIVE EXAMPLE |
| 384 | 18 | 2 | 0 | 40 | ABSENCE | 24 | E | E | E | INVENTION EXAMPLE |
| 385 | 18 | 2 | 0 | 40 | ABSENCE | 37 | M | E | E | INVENTION EXAMPLE |
| 386 | 18 | 2 | 0 | 40 | ABSENCE | 36 | M | E | E | INVENTION EXAMPLE |
| 387 | 18 | 2 | 0 | 40 | ABSENCE | 40 | M | E | E | INVENTION EXAMPLE |
| 388 | 18 | 2 | 0 | 40 | ABSENCE | 36 | W | E | E | COMPARATIVE EXAMPLE |
| 389 | 18 | 2 | 0 | 40 | ABSENCE | 37 | W | E | E | COMPARATIVE EXAMPLE |
| 390 | 18 | 3 | 10 | 40 | ABSENCE | 27 | E | E | E | INVENTION EXAMPLE |
| 391 | 18 | 10 | 10 | 40 | ABSENCE | 28 | M | E | E | INVENTION EXAMPLE |
| 392 | 18 | 15 | 10 | 40 | ABSENCE | 33 | M | E | E | INVENTION EXAMPLE |
| 393 | 18 | 17 | 10 | 40 | ABSENCE | 33 | W | E | E | COMPARATIVE EXAMPLE |
| 394 | 18 | 20 | 10 | 40 | ABSENCE | 32 | W | E | E | COMPARATIVE EXAMPLE |
| 395 | 18 | 30 | 10 | 40 | ABSENCE | 41 | W | E | E | COMPARATIVE EXAMPLE |
| 396 | 18 | 4 | 0 | 40 | ABSENCE | 25 | E | E | E | INVENTION EXAMPLE |
| 397 | 18 | 4 | 15 | 40 | ABSENCE | 28 | M | E | E | INVENTION EXAMPLE |
| 398 | 18 | 4 | 45 | 40 | ABSENCE | 30 | M | E | E | INVENTION EXAMPLE |
| 399 | 18 | 4 | 57 | 40 | ABSENCE | 32 | M | E | E | INVENTION EXAMPLE |
| 400 | 18 | 4 | 60 | 40 | ABSENCE | 33 | M | E | E | INVENTION EXAMPLE |
| 401 | 18 | 4 | 63 | 40 | ABSENCE | 32 | W | E | E | COMPARATIVE EXAMPLE |
| 402 | 18 | 4 | 70 | 40 | ABSENCE | 34 | W | E | E | COMPARATIVE EXAMPLE |
| 403 | 18 | 4 | 120 | 40 | ABSENCE | 40 | W | E | E | COMPARATIVE EXAMPLE |
| 404 | — | — | 45 | 40 | ABSENCE | UNMEASURABLE | W | E | W | COMPARATIVE EXAMPLE |
| 405 | 18 | 2 | 10 | 40 | ABSENCE | 25 | M | E | E | INVENTION EXAMPLE |
| 406 | 18 | 2 | 10 | 40 | ABSENCE | 24 | E | E | E | INVENTION EXAMPLE |
| 407 | 18 | 2 | 0 | 40 | ABSENCE | 26 | E | W | E | COMPARATIVE EXAMPLE |
| 408 | 18 | 2 | 0 | 40 | ABSENCE | 24 | E | E | E | INVENTION EXAMPLE |
| 409 | 18 | 2 | 0 | 40 | ABSENCE | 36 | M | E | E | INVENTION EXAMPLE |
| 410 | 18 | 2 | 0 | 40 | ABSENCE | 38 | M | E | E | INVENTION EXAMPLE |
| 411 | 18 | 2 | 0 | 40 | ABSENCE | 40 | M | E | E | INVENTION EXAMPLE |
| 412 | 18 | 2 | 0 | 40 | ABSENCE | 38 | W | E | E | COMPARATIVE EXAMPLE |
| 413 | 18 | 2 | 0 | 40 | ABSENCE | 37 | W | E | E | COMPARATIVE EXAMPLE |
| 414 | 18 | 3 | 10 | 40 | ABSENCE | 27 | E | E | E | INVENTION EXAMPLE |
| 415 | 18 | 10 | 10 | 40 | ABSENCE | 29 | M | E | E | INVENTION EXAMPLE |

TABLE 11-continued

| | | | | | | | | | | |
|---|---|---|---|---|---|---|---|---|---|---|
| 416 | 18 | 15 | 10 | 40 | ABSENCE | 32 | M | E | E | INVENTION EXAMPLE |
| 417 | 18 | 17 | 10 | 40 | ABSENCE | 35 | W | E | E | COMPARATIVE EXAMPLE |
| 418 | 18 | 20 | 10 | 40 | ABSENCE | 33 | W | E | E | COMPARATIVE EXAMPLE |
| 419 | 18 | 30 | 10 | 40 | ABSENCE | 39 | W | E | E | COMPARATIVE EXAMPLE |
| 420 | 18 | 4 | 0 | 40 | ABSENCE | 26 | E | E | E | INVENTION EXAMPLE |
| 421 | 18 | 4 | 15 | 40 | ABSENCE | 27 | M | E | E | INVENTION EXAMPLE |
| 422 | 18 | 4 | 45 | 40 | ABSENCE | 31 | M | E | E | INVENTION EXAMPLE |
| 423 | 18 | 4 | 57 | 40 | ABSENCE | 31 | M | E | E | INVENTION EXAMPLE |
| 424 | 18 | 4 | 60 | 40 | ABSENCE | 33 | M | E | E | INVENTION EXAMPLE |
| 425 | 18 | 4 | 63 | 40 | ABSENCE | 35 | W | E | E | COMPARATIVE EXAMPLE |
| 426 | 18 | 4 | 70 | 40 | ABSENCE | 36 | W | E | E | COMPARATIVE EXAMPLE |
| 427 | 18 | 4 | 120 | 40 | ABSENCE | 43 | W | E | E | COMPARATIVE EXAMPLE |
| 428 | 18 | 3 | 0 | 40 | ABSENCE | 24 | E | E | E | REFERENCE EXAMPLE |
| 429 | 18 | 3 | 5 | 40 | ABSENCE | 45 | W | E | E | COMPARATIVE EXAMPLE |

Note that after finishing the cold-rolled sheet annealing, presence/absence of decarburized layers on surface layers of the steel sheets was evaluated. Regarding the obtained samples, small pieces were each taken from the vicinity of a longitudinal direction central portion and a width direction central portion, and after filling cross sections thereof with resin, mechanical polishing and finish mirror polishing were performed. Thereafter, at 10 μm intervals in a sheet thickness direction from each of uppermost surface layers of the samples, by using a micro Vickers hardness tester, hardnesses thereof were measured with a measuring load set to 0.01 kgf, to obtain hardness profiles. Further, hardnesses at central portions in the sheet thickness directions in the taken small pieces were measured to be compared with the hardness profiles of the uppermost surface layers. As long as a dimension in a thickness direction in a region which was softer than 90% of each of the hardnesses at the central portions was 20 μm or less, a thickness of the decarburized layer was evaluated as "Excellent (E)" as being within an allowable range, and as long as the dimension was 30 μm or more, the thickness was evaluated as "Worse (W)". Table 3 to Table 11 present the results thereof.

In rinse waters used in the water washing, pure water was produced by a pure water manufacturing apparatus, and potassium chloride having each of predetermined amounts was added to the pure water as necessary to adjust an electrical conductivity. At this time, the electrical conductivities were measured by a hand-held electrical conductivity meter ES-51 manufactured by HORIBA, Ltd. As long as a $K^+$ ion concentration and a $Cl^-$ ion concentration in the rinse water satisfied the formula 1, the rinse water was evaluated as "Excellent (E)", and as long as they did not satisfy the formula 1, the rinse water was evaluated as "Worse (W)". Further, when the dissolved oxygen content of the pure water was measured by a diaphragm electrode method, it was 2.4 mg/L. Table 12 presents compositions of the rinse waters, measured values of the electrical conductivity, and calculated values of the electrical conductivity obtained by (formula 1).

TABLE 12

| COMPOSITION OF RINSE WATER | ION CONCENTRATION (mol/L) $K^+$ | ION CONCENTRATION (mol/L) $Cl^-$ | ELECTRICAL CONDUCTIVITY (mS/m) CALCULATED VALUE | ELECTRICAL CONDUCTIVITY (mS/m) MEASURED VALUE |
|---|---|---|---|---|
| PUKE WATER | — | — | — | 0.22 |
| PURE WATER + KCl (0.0002 mol/L) | 0.0002 | 0.0002 | 3.0 | 2.9 |
| PUKE WATER + KCl (0.0025 mol/L) | 0.0025 | 0.0025 | 37.5 | 33 |
| PUKE WATER + KCl (0.01 mol/L) | 0.01 | 0.01 | 149.9 | 136 |
| PUKE WATER + KCl (0.1 mol/L) | 0.1 | 0.1 | 1499 | 1241 |

The water washing was performed by, immediately after pulling the respective samples out of a solution for pickling, continuing exposures of central portions of the respective samples to the predetermined rinse waters at a predetermined flow rate for predetermined times. At this time, a supply rate of the rinse waters was set to be constant at 7 L/min by using Toyo Pump TP-G2 manufactured by MIYAKE KAGAKU Co., Ltd. Further, a water volume density was calculated to be 23 L/(second·$m^2$) since the test pieces were each 100 mm×50 mm and a water rate of the pump was 7 L/min. The drying was performed by exposing the respective samples to hot air from a blower.

Regarding the obtained samples, thicknesses of oxide films were measured by a glow discharge optical emission spectrometer (GDS). GDA750 manufactured by Rigaku Corporation was used as the GDS. A fixed quantity of each of the thicknesses of the oxide films was performed by confirming concentration profiles of the respective elements in a depth direction from each of the surface layers of the samples with the GDS and confirming a depth at which an oxygen concentration was reduced to half a maximum value thereof. A dimension from this depth position to the surface layer was regarded as each of the thicknesses of the oxide films. Table 3 to Table 11 present the results thereof.

Regarding the obtained samples, evaluation of conversion treatability was performed. A phosphate conversion treatment film was generated on a surface of each of the obtained samples. The phosphate conversion treatment was performed in order of degreasing, water washing, surface control, conversion treatment, re-washing with water, and drying. The degreasing was performed by, with respect to the obtained samples, spraying a degreasing agent FC-E2001 manufactured by Nihon Parkerizing Co., Ltd. at a temperature of 40° C. for second minutes. The water washing was performed by, with respect to the obtained samples, spraying room temperature tap water for 30 seconds. The surface control was performed by immersing the obtained samples in a bath of a surface conditioner PL-X manufactured by Nihon Parkerizing Co., Ltd. at room temperature for 30 seconds. The conversion treatment was performed by immersing the obtained samples in a bath at 35° C. of a chemical conversion treatment agent PB-SX manufactured by Nihon Parkerizing Co., Ltd. for two minutes. The re-washing with water was performed by, with respect to the obtained samples, spraying tap water for 30 seconds and subsequently spraying pure water for 30 seconds. The drying was performed by drying the obtained samples in an air-heating furnace. Regarding the samples in each of which the phosphate conversion treatment film was formed as described above, the conversion treatability was evaluated by the following procedure. Conversion crystals on the surface of each of the samples were photographed by a scanning electron microscope (SEM). As long as the conversion crystals were formed densely and a long side of each of the crystals was not less than 2 μm nor more than 4 μm, the conversion treatability was evaluated as "Excellent (E)". As long as the conversion crystals were formed densely and a long side of each of the crystals was more than 4 μm and 8 μm or less, the conversion treatability was evaluated as "Medium (M)". As long as the conversion crystals were not formed densely and an exposure of the sample itself was seen, or a long side of each of the crystals was more than 8 μm even though the conversion crystals were dense, the conversion treatability was evaluated as "Worse (W)". Table 3 to Table 11 present the results thereof.

Regarding the obtained samples, evaluation of degreasing ability was performed. After the above-described degreasing, water was made to adhere to the samples, and a visual observation was made. As long as the sample shed the water, the degreasing ability was evaluated as "Worse (W)", and as long as it did not shed the water, the degreasing ability was evaluated as "Excellent (E)". Table 3 to Table 11 present the results thereof.

As presented in Table 3 to Table 11, in each of a sample No. 4, a sample No. 5, a sample No. 7 to a sample No. 9, a sample No. 17, a sample No. 23, a sample No. 25, a sample No. 26, a sample No. 29, a sample No. 31, a sample No. 32, a sample No. 36 to a sample No. 39, a sample No. 42 to a sample No. 44, a sample No. 48 to a sample No. 52, a sample No. 57 to a sample No. 60, a sample No. 63 to a sample No. 65, a sample No. 69 to a sample No. 73, a sample No. 78 to a sample No. 81, a sample No. 84 to a sample No. 86, a sample No. 90 to a sample No. 94, a sample No. 99 to a sample No. 102, a sample No. 105 to a sample No. 107, a sample No. 111 to a sample No. 115, a sample No. 120 to a sample No. 123, a sample No. 126 to a sample No. 128, a sample No. 132 to a sample No. 136, a sample No. 141, a sample No. 142, a sample No. 144 to a sample No. 147, a sample No. 150 to a sample No. 152, a sample No. 156 to a sample No. 160, a sample No. 165, a sample No. 166, a sample No. 168 to a sample No. 171, a sample No. 174 to a sample No. 176, a sample No. 180 to a sample No. 184, a sample No. 189, a sample No. 190, a sample No. 192 to a sample No. 195, a sample No. 198 to a sample No. 200, a sample No. 204 to a sample No. 208, a sample No. 213, a sample No. 214, a sample No. 216 to a sample No. 219, a sample No. 222 to a sample No. 224, a sample No. 228 to a sample No. 232, a sample No. 237, a sample No. 238, a sample No. 240 to a sample No. 243, a sample No. 246 to a sample No. 248, a sample No. 252 to a sample No. 256, a sample No. 261, a sample No. 262, a sample No. 264 to a sample No. 267, a sample No. 270 to a sample No. 272, a sample No. 276 to a sample No. 280, a sample No. 285, a sample No. 286, a sample No. 288 to a sample No. 291, a sample No. 294 to a sample No. 296, a sample No. 300 to a sample No. 304, a sample No. 309, a sample No. 310, a sample No. 312 to a sample No. 315, a sample No. 318 to a sample No. 320, a sample No. 324 to a sample No. 328, a sample No. 333, a sample No. 334, a sample No. 336 to a sample No. 339, a sample No. 342 to a sample No. 344, a sample No. 348 to a sample No. 352, a sample No. 357, a sample No. 358, a sample No. 360 to a sample No. 363, a sample No. 366 to a sample No. 368, a sample No. 372 to a sample No. 376, a sample No. 381, a sample No. 382, a sample No. 384 to a sample No. 387, a sample No. 390 to a sample No. 392, a sample No. 396 to a sample No. 400, a sample No. 405, a sample No. 406, a sample No. 408 to a sample No. 411, a sample No. 414 to a sample No. 416, and a sample No. 420 to a sample No. 424, a dew point, an electrical conductivity of a rinse water, a water-washing time, a time from a water washing end to a drying start and a chemical composition fell within ranges of the present invention, so that good conversion treatability and degreasing ability were able to be obtained. In each of a sample No. 35, a sample No. 56, a sample No. 77, a sample No. 98, a sample No. 119, a sample No. 140, a sample No. 164, a sample No. 188, a sample No. 212, a sample No. 236, a sample No. 260, a sample No. 284, a sample No. 308, a sample No. 332, a sample No. 356, a sample No. 380 and a sample No. 404, the drying was performed without performing the water washing after the pickling, so that rust was formed thick on the surface, which made it impossible to measure the thickness of the oxide film.

Test Example 1

An electrical conductivity of a rinse water disclosed in Patent Literature 4 was obtained, and this was compared with the electrical conductivity of the rinse water used in the present invention. The rinse water of an experiment No. 1, which was the cleanest rinse water disclosed in Patent Literature 4, was reproduced. The respective ion concentrations are $Fe^{2+}$: 3.2 g/L, $NO_3^-$: 1.1 g/L, and $Cl^-$: 2.3 g/L. First, a solution in which $FeCl_2$ of 0.032 mol/L and $Fe(NO_3)_2$ of 0.009 mol/L were dissolved in pure water was produced. Regarding the obtained rinse water, the electrical conductivity was measured by using the hand-held electrical conductivity meter ES-51 manufactured by HORIBA, Ltd. Table 13 presents this result. Further, in Table 13, the ion concentrations and the electrical conductivities of the rinse waters used in the above-described Example 1 were written down together.

TABLE 13

| | ION CONCENTRATION (mol/L) | | | | ELECTRICAL CONDUCTIVITY |
|---|---|---|---|---|---|
| | $Fe^{2+}$ | $K^+$ | $Cl^-$ | $NO_3^-$ | MEASURED VALUE (mS/m) |
| EXPERIMENT No. 1 IN PATENT LITERATURE 4 | 0.041 | — | 0.064 | 0.018 | 715 |
| SAMPLE No. 7-9, No. 16-19 | — | 0.0002 | 0.0002 | — | 2.9 |
| SAMPLE No. 10-11, No. 20-21 | — | 0.0025 | 0.0025 | — | 33 |
| SAMPLE No. 12-13 | — | 0.01 | 0.01 | — | 136 |
| SAMPLE No. 14-15 | — | 0.1 | 0.1 | — | 1241 |

As presented in Table 13, it was confirmed that the electrical conductivity of the cleanest rinse water disclosed in Patent Literature 4 fell outside the range of the present invention.

The invention claimed is:

1. A manufacturing method of a steel sheet comprising:

a step of performing continuous casting of molten steel having a Si content of 0.4 mass % to 3.0 mass % to obtain a slab;

a step of performing hot rolling of the slab to obtain a hot-rolled steel sheet;

a step of performing cold rolling of the hot-rolled steel sheet to obtain a cold-rolled steel sheet;

a step of performing cold-rolled sheet annealing of the cold-rolled steel sheet;

a step of performing pickling after the cold-rolled sheet annealing;

a step of performing water washing after the pickling; and a step of performing drying after the water washing, wherein a dew point is set to −35° C. or lower in the cold-rolled sheet annealing, wherein an electrical conductivity of a rinse water to be used in the water washing is set to 5.0 mS/m or less, wherein a water-washing time is set to 15 seconds or less in the water washing, and wherein the drying is started within 60 seconds from an end of the water washing.

2. The manufacturing method of the steel sheet according to claim 1, wherein a Mn content of the molten steel is 0.5 mass % to 4.0 mass %.

3. The manufacturing method of the steel sheet according to claim 1, wherein the rinse water comprises $H^+$; as an essential ion; and $Na^+$, $Mg^{2+}$, $K^+$, $Ca^{2+}$, $Fe^{2+}$, $Fe^{3+}$, $Cl^-$, $NO_3^-$, and $SO_4^{2-}$ ions, as optional ions, and a formula 1 is satisfied for the electrical conductivity of the rinse water:

$$349.81[H^+]+50.1[Na^+]+53.05\times2[Mg^{2+}]+73.5[K^+]+59.5\times2[Ca^{2+}]+53.5\times2[Fe^{2+}]+68.4\times3[Fe^{3+}]+76.35[Cl^-]+71.46[NO_3^-]+80.0\times2[SO_4^{2-}]\leq0.05 \text{ S/m} \quad \text{(formula 1)}$$

wherein when a concentration (mol/L) of $H^+$ is set as $[H^+]$, a concentration (mol/L) of $Na^+$ is set as $[Na^+]$, a concentration (mol/L) of $Mg^{2+}$ is set as $[Mg^{2+}]$, a concentration (mol/L) of $K^+$ is set as $[K^+]$, a concentration (mol/L) of $Ca^{2+}$ is set as $[Ca^{2+}]$, a concentration (mol/L) of $Fe^{2+}$ is set as $[Fe^{2+}]$, a concentration (mol/L) of $Fe^{3+}$ is set as $[Fe^{3+}]$, a concentration (mol/L) of $Cl^-$ is set as $[Cl^-]$, a concentration (mol/L) of $NO_3^-$ is set as $[NO_3^-]$, and a concentration (mol/L) of $SO_4^{2-}$ is set as $[SO_4^{2-}]$.

4. The manufacturing method of the steel sheet according to claim 2, wherein the rinse water comprises $H^+$, as an essential ion, and $Na^+$, $Mg^{2+}$, $K^+$, $Ca^{2+}$, $Fe^{2+}$, $Fe^{3+}$, $Cl^-$, $NO^{3-}$, and $SO_4^{2-}$ ions, as optional ions, and a formula 1 is satisfied for the electrical conductivity of the rinse water:

$$349.81[H^+]+50.1[Na^+]+53.05\times2[Mg^{2+}]+73.5[K^+]+59.5\times2[Ca^{2+}]+53.5\times2[Fe^{2+}]+68.4\times3[Fe^{3+}]+76.35[Cl^-]+71.46[NO_3^-]+80.0\times2[SO_4^{2-}]\leq0.05 \text{ S/m} \quad \text{(formula 1)}$$

wherein a concentration (mol/L) of $H^+$ is set as $[H^+]$, a concentration (mol/L) of $Na^+$ is set as $[Na^+]$, a concentration (mol/L) of $Mg^{2+}$ is set as $[Mg^{2+}]$, a concentration (mol/L) of $K^+$ is set as $[K^+]$, a concentration (mol/L) of $Ca^{2+}$ is set as $[Ca^{2+}]$, a concentration (mol/L) of $Fe^{2+}$ is set as $[Fe^{2+}]$, a concentration (mol/L) of $Fe^{3+}$ is set as $[Fe^{3+}]$, a concentration (mol/L) of $Cl^-$ is set as $[Cl^-]$, a concentration (mol/L) of $NO_3^-$ is set as $[NO_3^-]$, and a concentration (mol/L) of $SO_4^{2-}$ is set as $[SO_4^{2-}]$.

* * * * *